US006237491B1

(12) United States Patent
Yasuhara et al.

(10) Patent No.: US 6,237,491 B1
(45) Date of Patent: May 29, 2001

(54) APPARATUS FOR POSITIONING A PRINTING PLATE TO A PLATE CYLINDER OF A PRINTING MACHINE

(75) Inventors: Yoshihiro Yasuhara; Masazumi Hidera, both of Fuchu (JP)

(73) Assignee: Ryobi Ltd., Hiroshima-Ken (JP)

( * ) Notice: Subject to any disclaimer, the term of this patent is extended or adjusted under 35 U.S.C. 154(b) by 0 days.

(21) Appl. No.: 09/399,542

(22) Filed: Sep. 20, 1999

(30) Foreign Application Priority Data

Sep. 21, 1998 (JP) ..... 10-266530

(51) Int. Cl.[7] ..... B41F 27/12
(52) U.S. Cl. ..... 101/415.1; 101/477
(58) Field of Search ..... 101/415.1, 409, 101/378, 477

(56) References Cited

U.S. PATENT DOCUMENTS 2,621,592 * 12/1952 Faeber ..... 101/415.1
3,738,268 * 6/1973 Swordy et al. ..... 101/415.1
3,795,193 * 3/1974 Johne et al. ..... 101/415.1
3,824,928 * 7/1974 Langer ..... 101/415.1
3,835,778 * 9/1974 Bock ..... 101/415.1
5,370,051 * 12/1994 Schild et al. ..... 101/415.1
5,440,988 * 8/1995 Ito ..... 101/477
5,443,006 * 8/1995 Beisel et al. ..... 101/477
5,460,092 * 10/1995 Beisel et al. ..... 101/477

FOREIGN PATENT DOCUMENTS 6-286112 10/1994 (JP) .

* cited by examiner

*Primary Examiner*—John S. Hilten
*Assistant Examiner*—Leslie J. Grohusky
(74) *Attorney, Agent, or Firm*—Merchant & Gould P.C.

(57) ABSTRACT

A leading edge side part 10*a* of a printing plate 10 can easily be inserted into a gap L1 formed between a plate guide 15 positioned adjacent to positioning pins 11 and a leading edge side clamping base 51 because the gap L1 is formed in a thickness slightly thicker than the printing plate 10. Restoring force caused by flexure of the printing plate 10 allows the leading edge side part 10*a* thereof being inserted into the gap L1, the restoring force being generated when a tail edge side part 10*b* of the printing plate 10 is in contact with a contact member 2.

14 Claims, 17 Drawing Sheets

<PRIOR ART>

<PRIOR ART>

APPARATUS FOR POSITIONING A PRINTING PLATE TO A PLATE CYLINDER OF A PRINTING MACHINE

CROSS-REFERENCE TO RELATED APPLICATIONS

This application is based on Application No. Hei 10-266530 filed on Sep. 21, 1998 in Japan, the content of which is incorporated hereinto by reference.

BACKGROUND OF THE INVENTION

1. Field of the Invention

The present invention relates to an apparatus for positioning a printing plate to a plate cylinder of a printing machine and, more specifically, to a positioning apparatus for carrying out positioning of the printing plate to the plate cylinder by contacting a fore-end of the printing plate to a reference member provided on a clamping base of the plate cylinder.

2. Description of the Prior Art

FIG. 15 shows a sectional side elevation of a plate cylinder 45. The plate cylinder 45 is rotatably supported with a plate cylinder shaft 45J to a body of a printing machine. A printing plate 10 is disposed on an outer surface of the plate cylinder 45.

In order to dispose the plate 10 on the cylinder 45, the operator of the printing machine initially inserts a leading edge side part 10*a* of the plate 10 into a gap formed between a leading edge side clamping base 51 and a leading edge side clamp 52, then the leading edge side part 10*a* is clamped therebetween by closing the leading edge side clamp 52.

Next, the plate 10 is rolled around the outer surface of the cylinder 45, and then a tail edge side part 10*b* of the plate 10 is inserted between a tail edge side clamping base 53 and a tail edge side clamp 54. The tail edge side part 10*b* is clamped therebetween by closing the tail edge side clamp 54. Thereafter, the plate 10 is fitted tightly on the outer surface of the cylinder 45 by pulling the tail edge side part 10*b* as a result of moving both the tail edge side clamping base 53 and the tail edge side clamp 54.

In order to carry out appropriate printing work, the plate 10 needs to be disposed on the outer surface of the cylinder 45 with accuracy. To do that, cut-out parts 10S for positioning are formed at two separate positions on the leading edge side part 10*a* of the plate 10 as depicted in FIG. 14. Two separate positioning pins 11 responsive to the cut-out parts 10S are provided to the leading edge side clamping base 51 of the cylinder 45 in fixed manner as shown in FIG. 16.

Further, a temporal fixer 20 depicted in FIG. 16 is provided to the clamping base 51. The temporal fixer 20 is made of a thin metal plate and the fixer 20 is arranged such that a part adjacent to a fore-end thereof is in contact with an upper surface 51F of the clamping base 51.

The operator carries out positioning of the plate 10 accurately by contacting cut-out planes 13 of the cut-out parts 10S (FIG. 14) with the positioning pins 11 while inserting the leading edge side part 10*a* between the fixer 20 and the upper surface 51F with force when the leading edge side part 10*a* is inserted between the leading edge side clamping base 51 and the leading edge side clamp 52.

The fixer 20 has elasticity because it is made of a thin metal-plate. The elasticity thereof allows the fixer 20 to fix the leading edge side part 10*a* between the fixer 20 and the upper surface 51F under a temporarily basis. The leading edge side part 10*a* is clamped between the leading edge side clamping base 51 and the leading edge side clamp 52 by closing the leading edge side clamp 52 as a result of rotating a cam (not shown) with a spanner and/or similar tool(s) under the condition described above.

Another conventional apparatus for positioning a printing plate is disclosed in Japanese patent laid-open publication No. Hei 6-286112. The overall mechanisms of the apparatus are shown in FIG. 17. In the conventional apparatus, the leading edge side part 10*a* is inserted between the leading edge side clamping base 51 and the leading edge side clamp 52 as a result of suspending the printing plate 10 downwardly to the plate cylinder 45 with the apparatus.

A cylinder 26 is provided with to a safety cover 28 for a printing unit, and a pair of cover arms 23 are connected to the cylinder 26 through a link mechanism 27. A protection cover 22 is suspended and held by the cover arms 23. A shaft 24 is provided to the cover arms 23 so as to cross therebetween, and a stopper 21 is provided on the shaft 24.

In the normal state, the protection cover 22 is positioned adjacent to the safety cover 28. The protection cover 22 is moved to the position shown in FIG. 17 by actuating the cylinder 26. Thereafter, the leading edge side part 10*a* is inserted between the leading edge side clamping base 51 and the leading edge side clamp 52 while contacting the tail edge side part 10*b* to the stopper 21. At that time, guide rollers 25 provided on the protection cover 22 support the printing plate 10. The leading edge side part 10*a* is clamped to the leading edge side clamping base 51 and the leading edge side clamp 52 is closed by closing the leading edge side clamp 52 under the condition depicted in FIG. 17.

The conventional apparatuses for positioning a printing plate, however, have the following problems to be solved. In order to dispose the plate 10 on the cylinder 45 at a proper position, the cut-out planes 13 of the cut-out parts 10S need to be accurately contacted with the positioning pins 11 provided to the leading edge side clamping base 51 as two separate pins.

The cut-out planes 13 possibly contact with the positioning pins 11 in insufficient ways because the leading edge side part 10*a* is inserted between the fixer 20 and the upper surface 51F with force. Uneven contact of the cut-out planes 13 to the positioning pins 11 makes diagonal placement of the printing plate 10 on the plate cylinder 45 possible. Consequently, printing accuracy may be decreased as a result of diagonal images caused by the diagonal placement.

There is a high probability to deform the cut-out planes 13 as a result of giving too much force thereto when the operator tries hard to contact the cut-out planes 13 with the positioning pins 11 sufficiently. Consequently, printing accuracy may also be decreased as a result of diagonal images caused by the deformation of the cut-out planes 13.

As described above, printing accuracy may be decreased as a result of difficulties of disposing the printing plate 10 on the cylinder 45 at a proper position when the apparatus depicted in FIG. 16 in which the leading edge side part 10*a* being fixed under a temporarily basis, is used. It requires the operator to be skillful in order to dispose the printing plate 10 at a proper position.

In the apparatus shown in FIG. 17, the leading edge side part 10*a* can not be inserted between the leading edge side clamping base 51 and the leading edge side clamp 52 with force because the leading edge side part 10*a* is inserted therebetween by its weight or flexure thereof. In this way, the apparatus employs a mechanism in which the cut-out planes 13 just contact with the positioning pins 11 while not employing the fixer 20 depicted in FIG. 16.

The printing plate 10 might be held under a condition that a part adjacent to the leading edge side part 10*a* comes up from the upper surface 51F of the clamping base 51. The leading edge side part 10*a* moves its position to an axis of the positioning pins 11 (vertical direction in FIG. 16) when the leading edge side clamp 52 is closed as a result of pushing force thereof. Consequently, printing accuracy may be decreased as a result of diagonal images caused by its diagonal placement.

In addition, the apparatus shown in FIG. 17 requires many parts such as the cylinder 26, the link mechanism 27, the cover arms 23, the protection cover 22, the guide rollers 25 and so on. Consequently, complex mechanisms are needed, and the printing plate 10 is supported in an unstable manner.

OBJECTS AND SUMMARY OF THE INVENTION

It is an object of the present invention to provide an apparatus for positioning a printing plate to a plate cylinder of a printing machine capable of increasing printing accuracy by carrying out accurate positioning of the printing plate without demanding much skill in plate positioning, as well as simplifying its structure and increasing stability of support for the printing plate.

In accordance with characteristics of the present invention, there is provided an apparatus for positioning a printing plate to a plate cylinder of a printing machine comprising:

a reference member provided to a clamping base of the plate cylinder of the printing machine, the reference member being in contact with a fore-end of the printing plate for positioning the printing plate to the plate cylinder; and a guide member provided adjacent to the reference member for guiding the fore-end of the printing plate to the reference member, the guide member being provided to the clamping base so as to form a gap therebetween within a range from a thickness substantially equal to the printing plate to a thickness slightly thicker than the printing plate.

While the novel features of the invention are set forth in a general fashion, both as to organization and content, the invention will be better understood and appreciated, along with other objects and features thereof from the following detailed description taken in conjunction with the drawings.

DESCRIPTION OF THE PREFERRED EMBODIMENT

Figure 1:
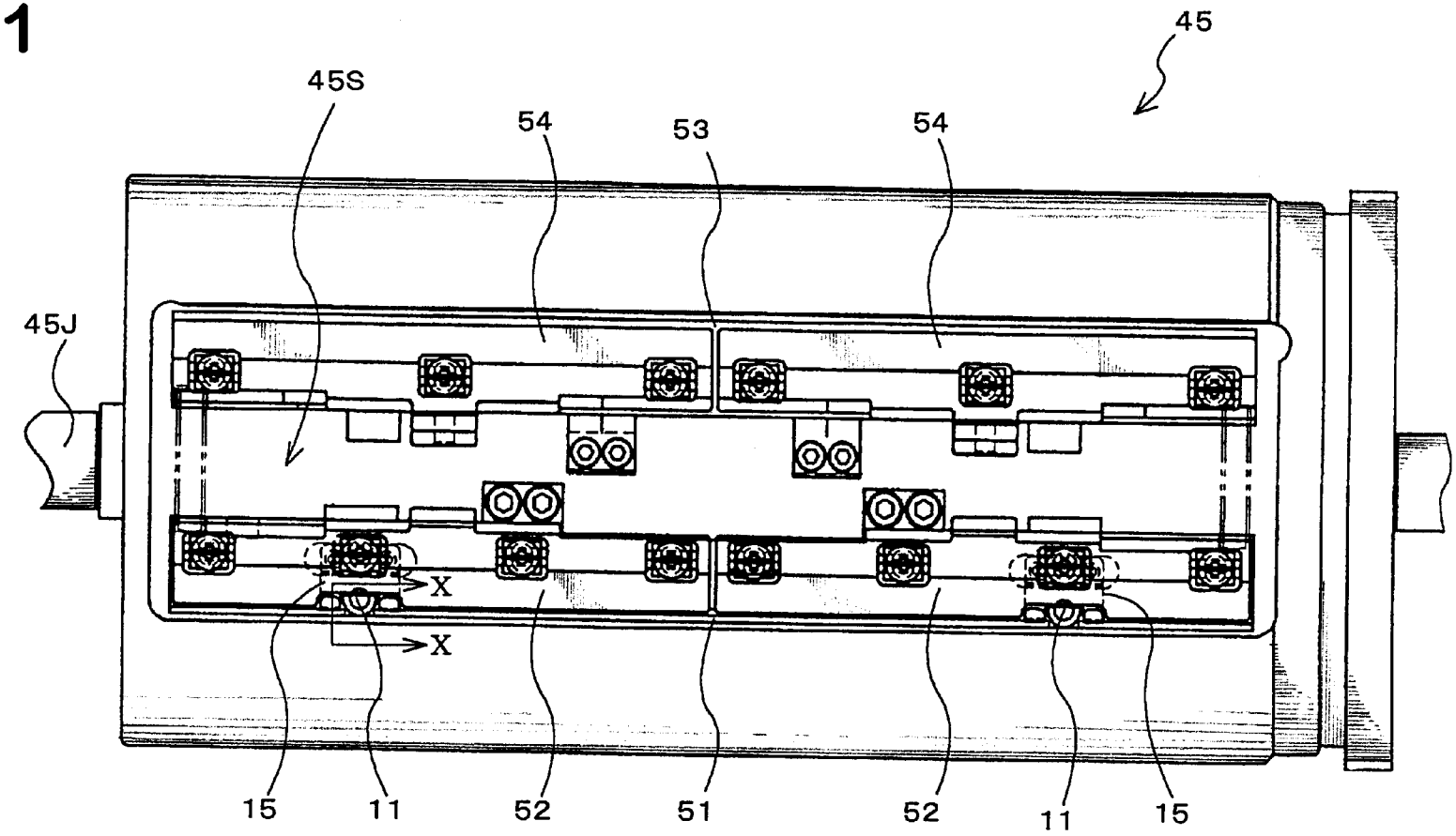
FIG. 1 is a plan view of a plate cylinder 45 in an embodiment of an apparatus for positioning a printing plate to a plate cylinder of a printing machine according to the present invention.
Figure 2:
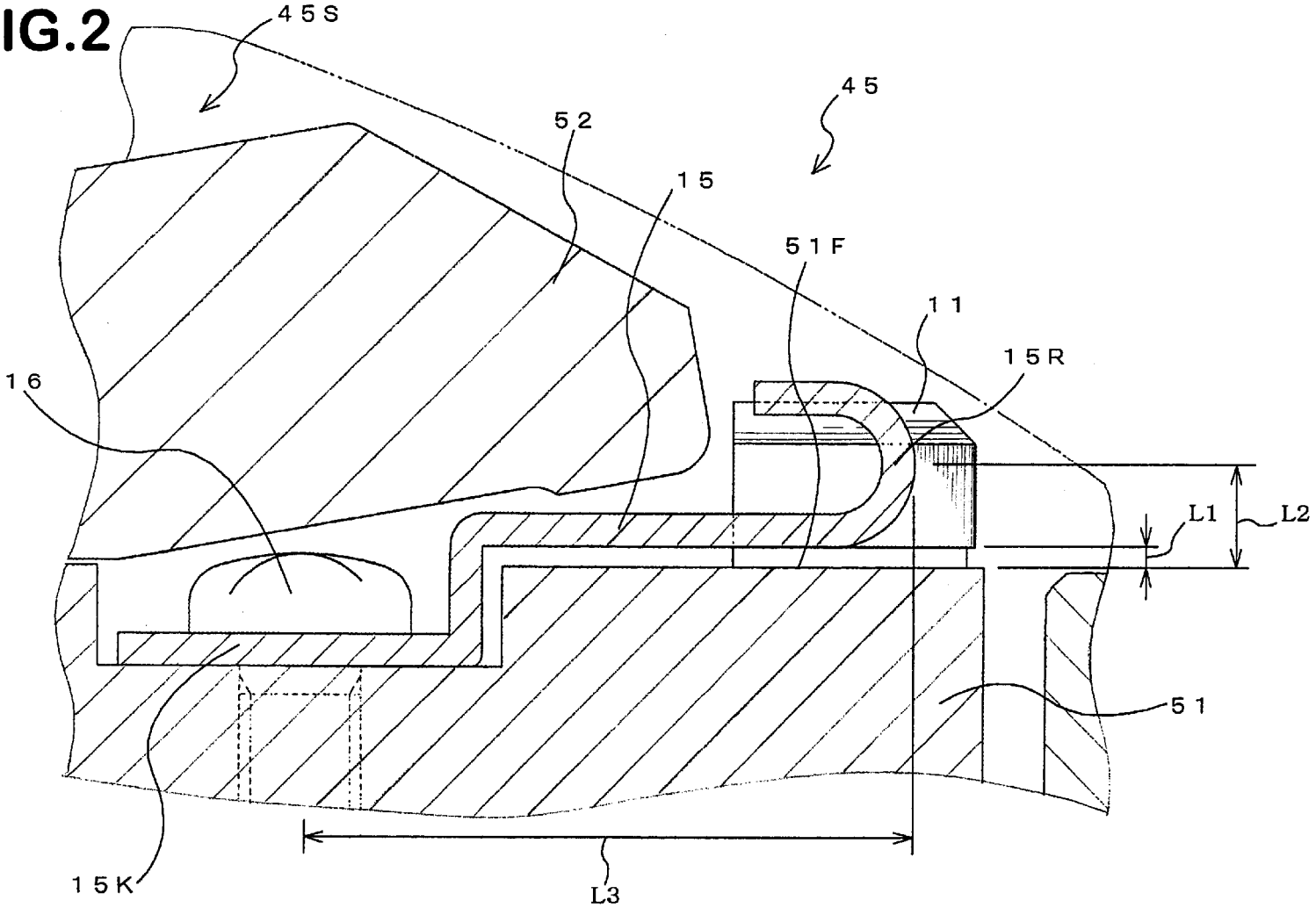
FIG. 2 is an enlarged cross sectional view taken along line X—X of FIG. 1.
Figure 3A:
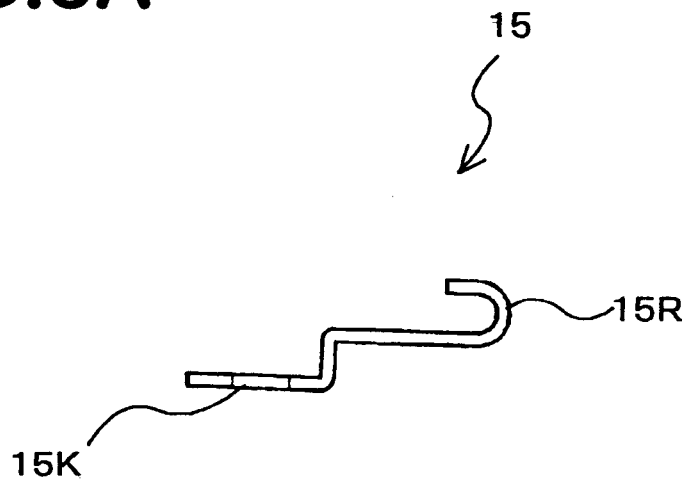
FIG. 3A is a side view of a plate guide 15 shown in FIG. 2.
Figure 3B:
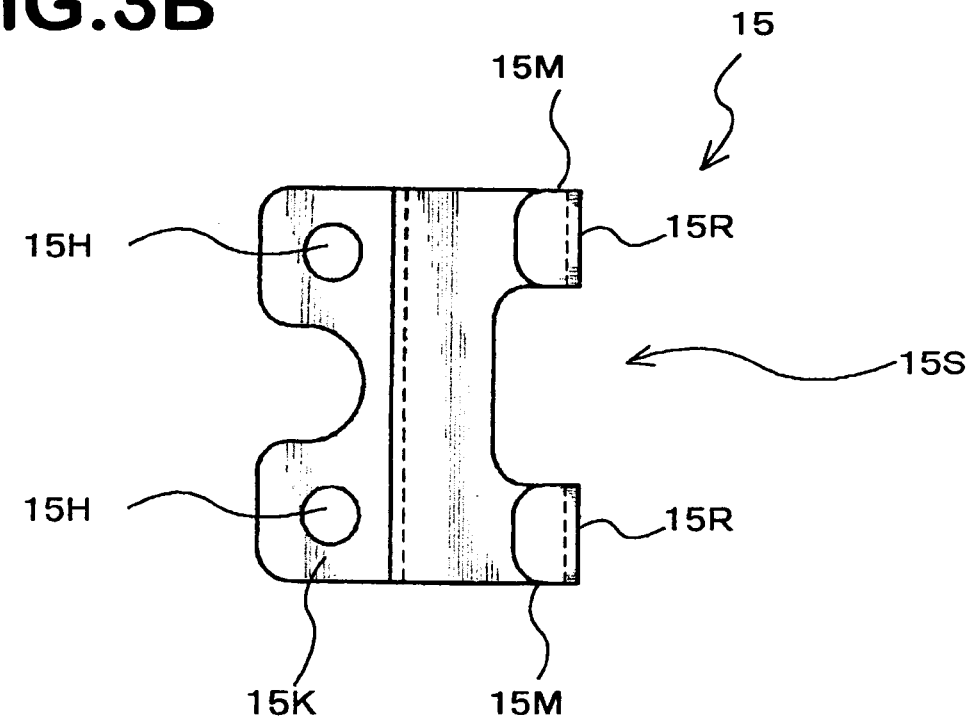
FIG. 3B is a plan view of the plate guide 15 shown in FIG. 2.

An embodiment of an apparatus for positioning a printing plate to a plate cylinder of a printing machine according to the present invention will be described with reference to the figures. FIG. 1 is a plan view of a plate cylinder 45 in this embodiment, and FIG. 2 is an enlarged cross sectional view taken along line X—X of FIG. 1. Further, FIG. 3A is a side view of a plate guide 15 shown in FIG. 2, and FIG. 3B is a plan view thereof shown in FIG. 2.

Figure 4:
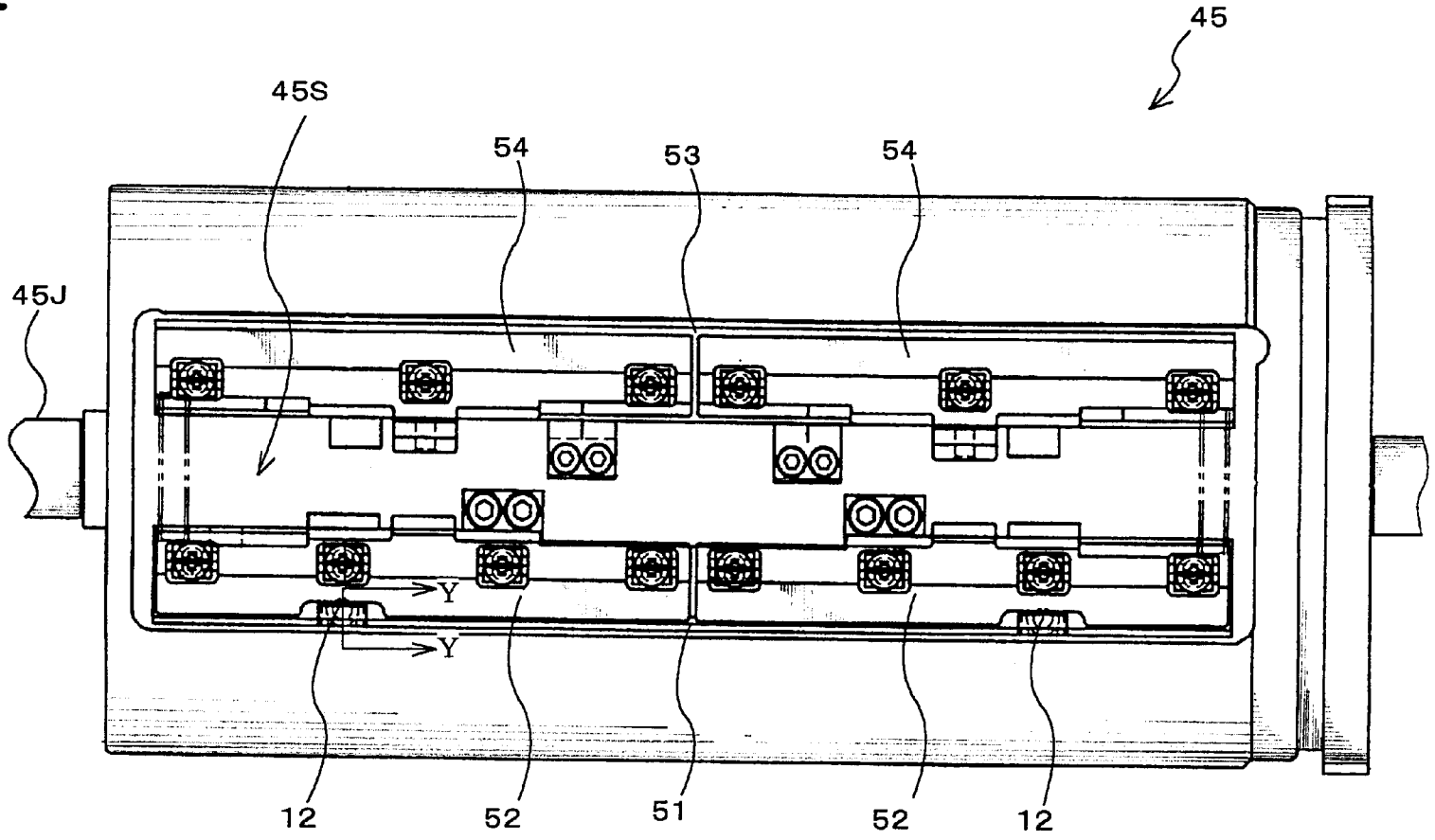
FIG. 4 is a plan view of the plate cylinder 45 in another embodiment of the apparatus for positioning a printing plate to a plate cylinder of a printing machine according to the present invention.
Figure 5:
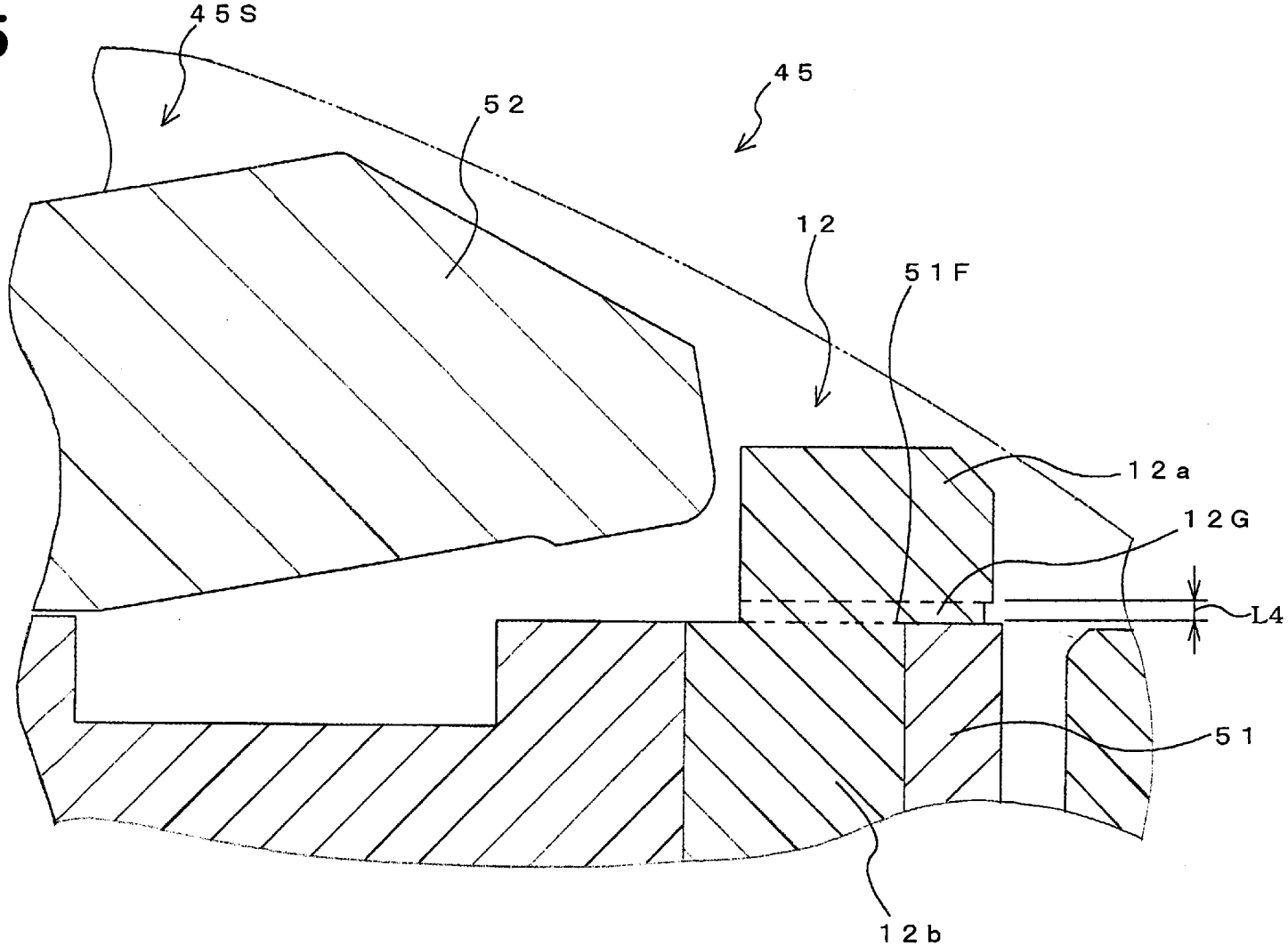
FIG. 5 is an enlarged cross sectional view taken along line Y—Y of FIG. 4.
Figure 6A:
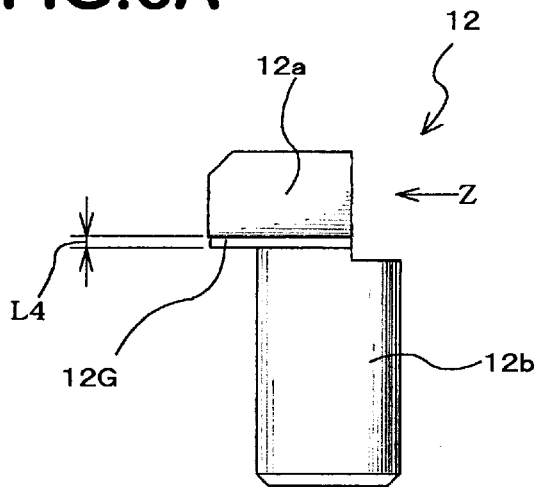
FIG. 6A is a side view of a unitized positioning pin 12 (a side view looking at the opposite side of the view in FIG. 5).
Figure 6B:
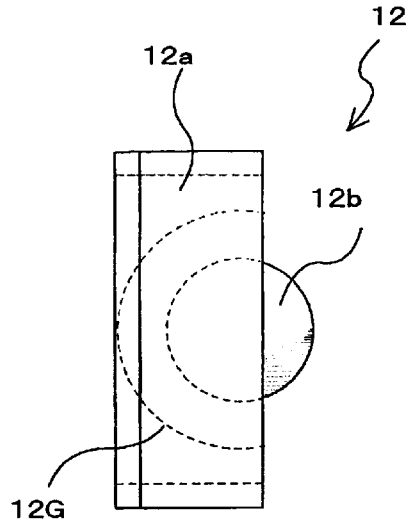
FIG. 6B is a plan view of the unitized positioning pin 12.
Figure 6C:
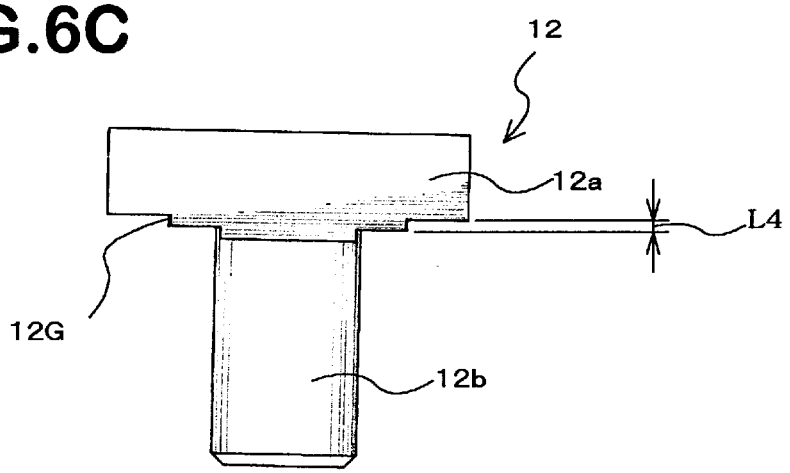
FIG. 6C is a front view of the unitized positioning pin 12 looking at a direction Z shown in FIG. 6A.

FIG. 4 is a plan view of the cylinder 45 in another embodiment of the present invention, and FIG. 5 is an enlarged cross sectional view taken along line Y—Y of FIG. 4. Further, FIG. 6A is a side view of a unitized positioning pin 12 (a side view looking at the opposite side of the view in FIG. 5), FIG. 6B is a plan view of the positioning pin 12, and FIG. 6C is a front view thereof looking at a direction Z shown in FIG. 6A.

Figure 7:
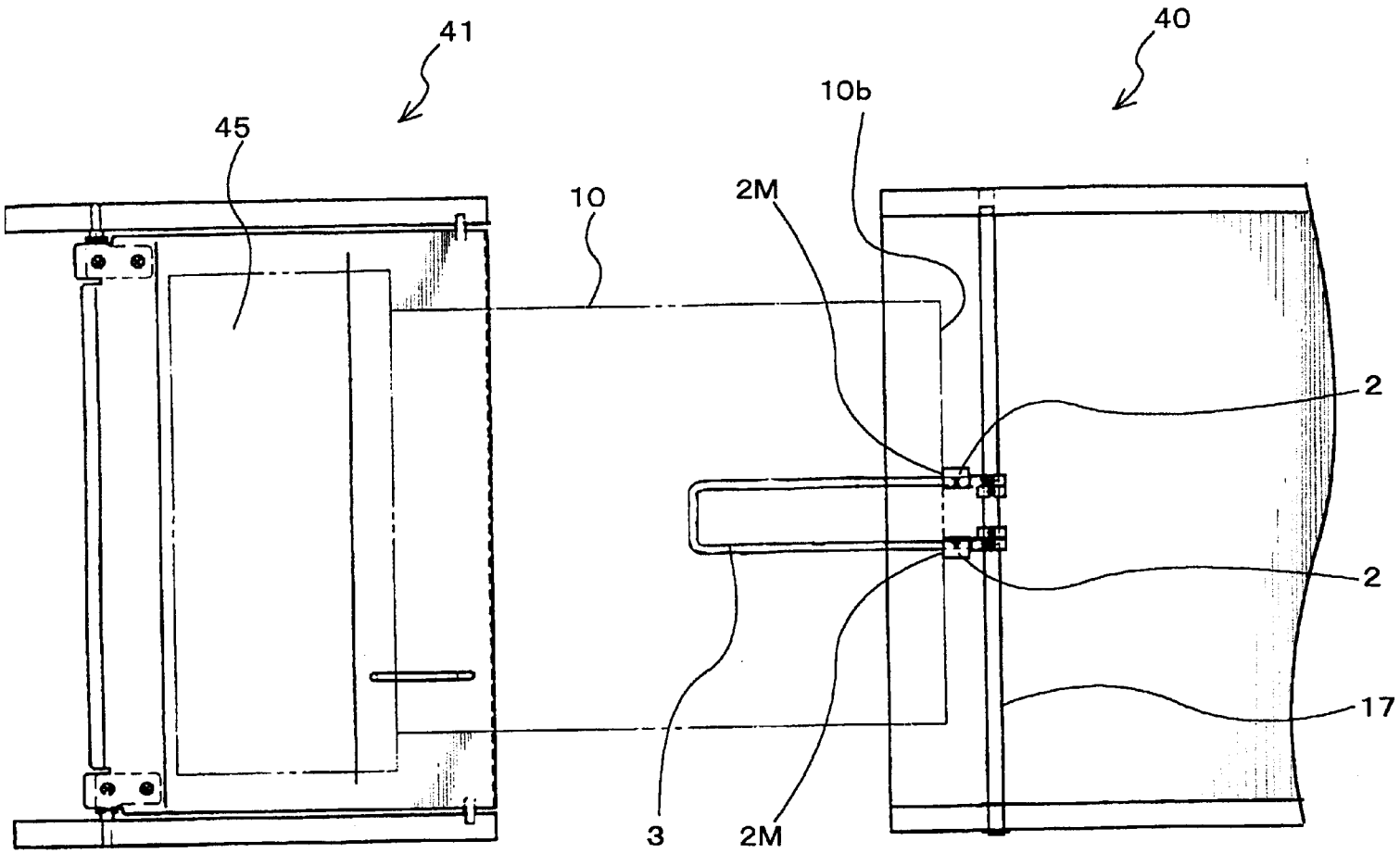
FIG. 7 is a plan view of a feeder 40 and a first printing unit 41.
Figure 8:
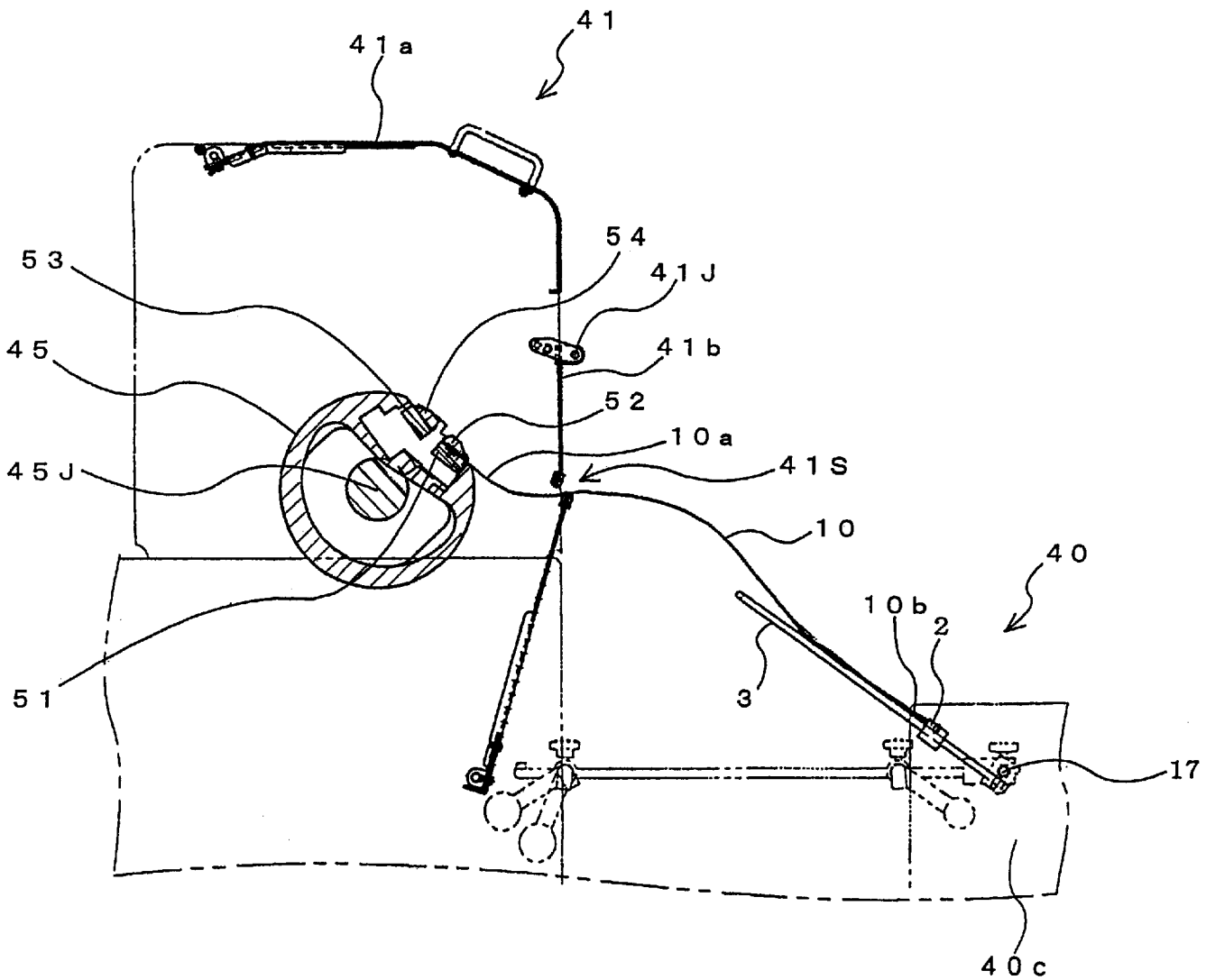
FIG. 8 is a side view corresponding to the view shown in FIG. 7.
Figure 9:
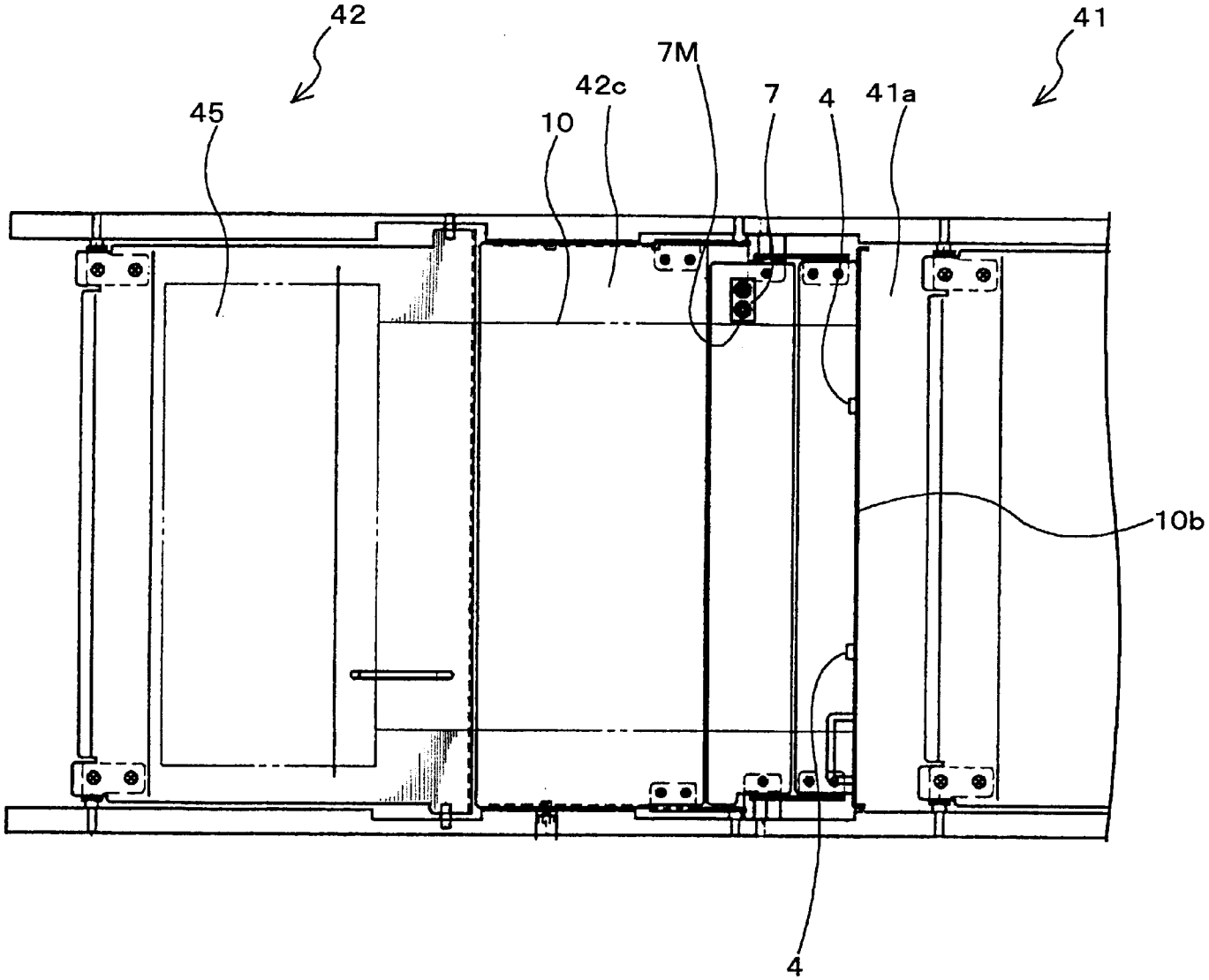
FIG. 9 is a plan view of the first printing unit 41 and a second printing unit 42.
Figure 10:
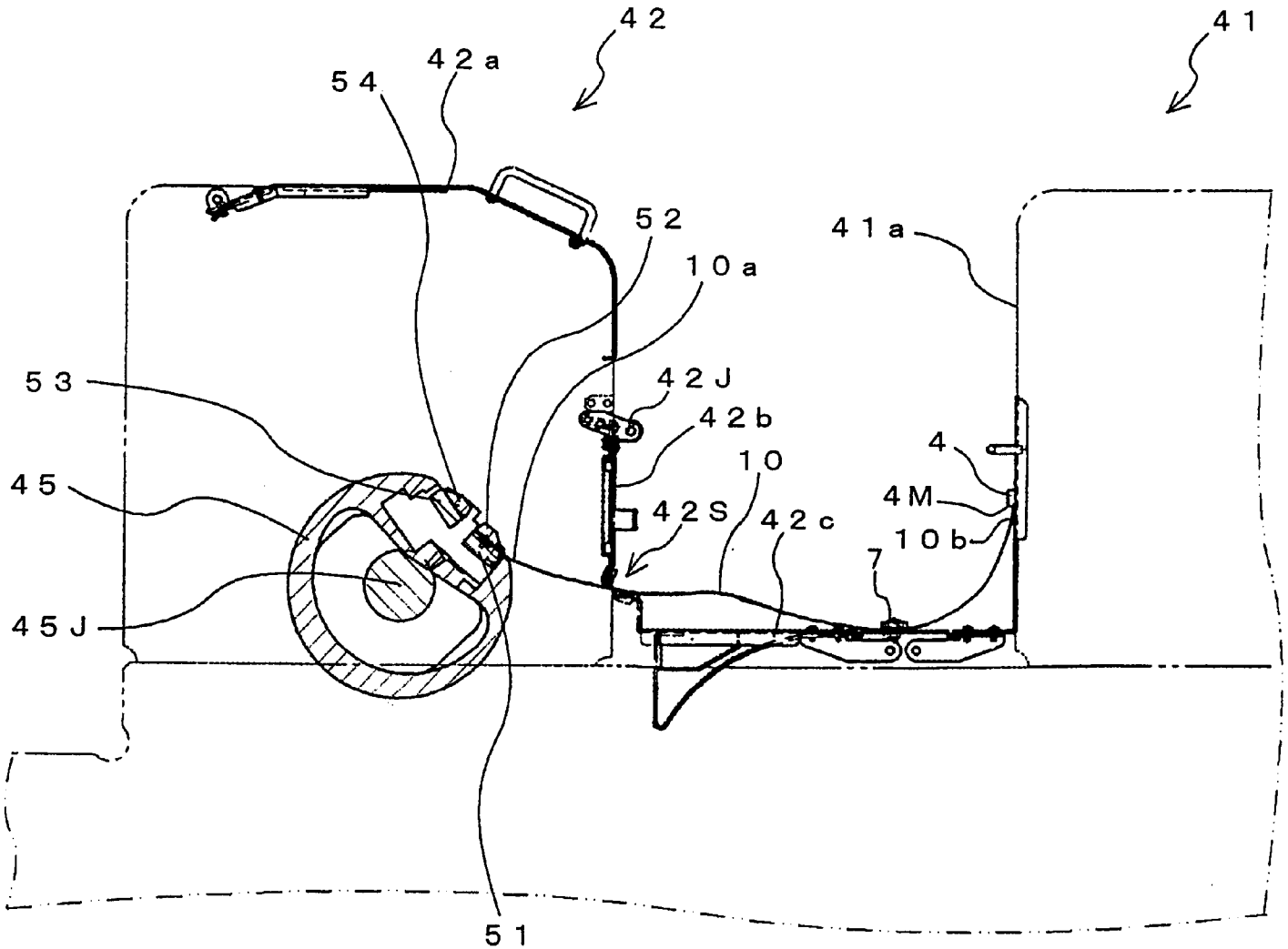
FIG. 10 is a side view corresponding to the view shown in FIG. 9.
Figure 11:
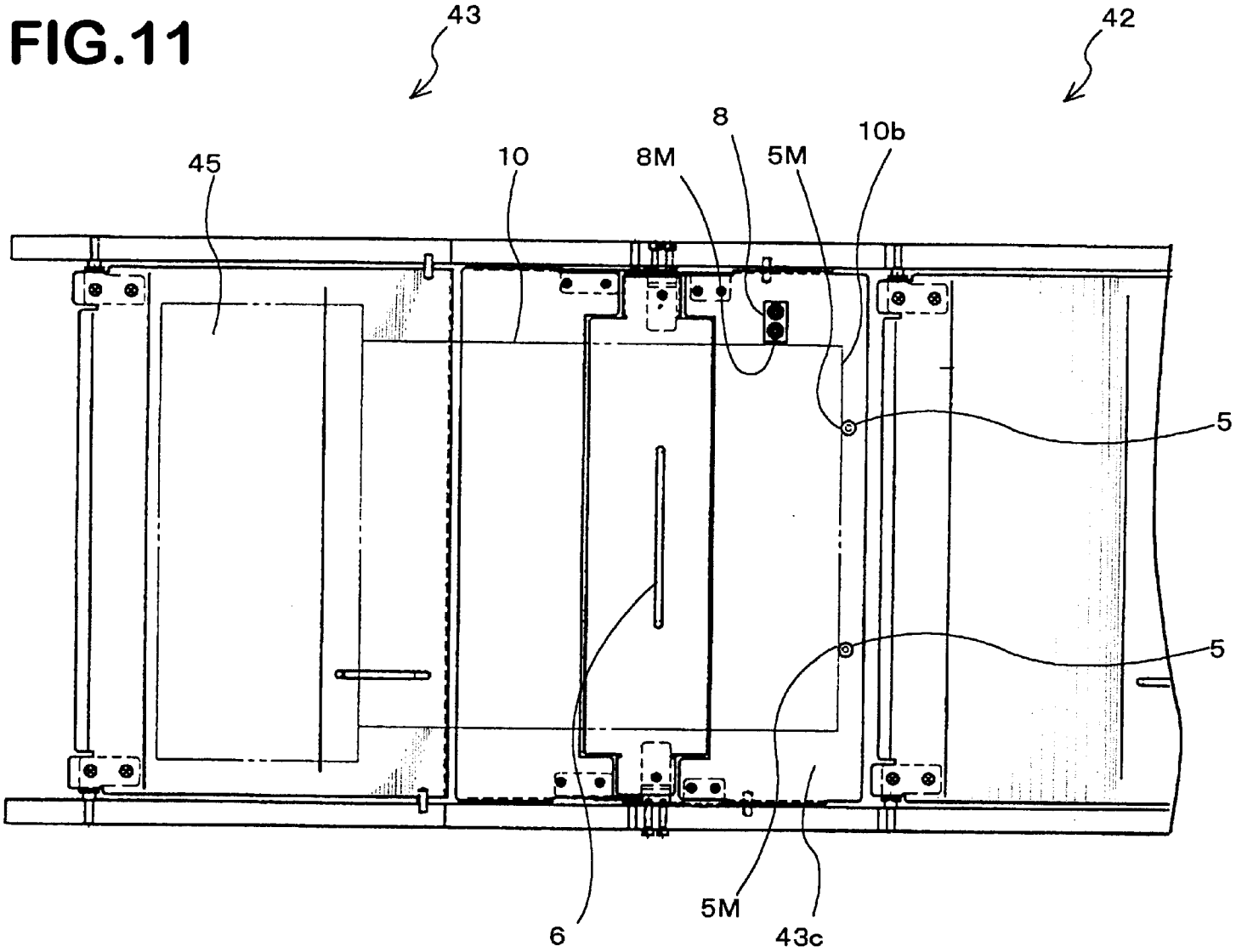
FIG. 11 is a plan view of the second printing unit 42 and a third printing unit 43.
Figure 12:
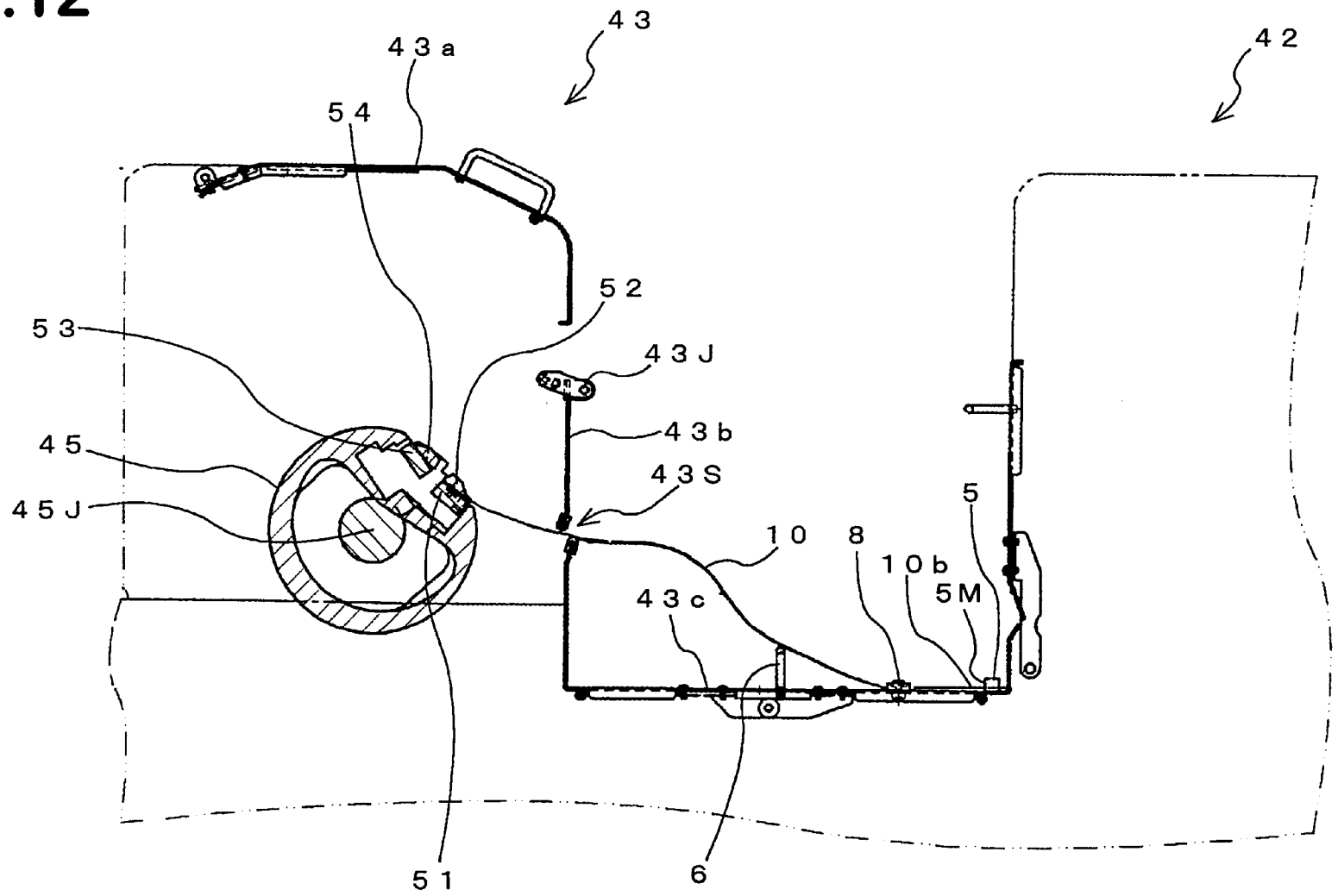
FIG. 12 is a side view corresponding to the view shown in FIG. 11.
Figure 13:
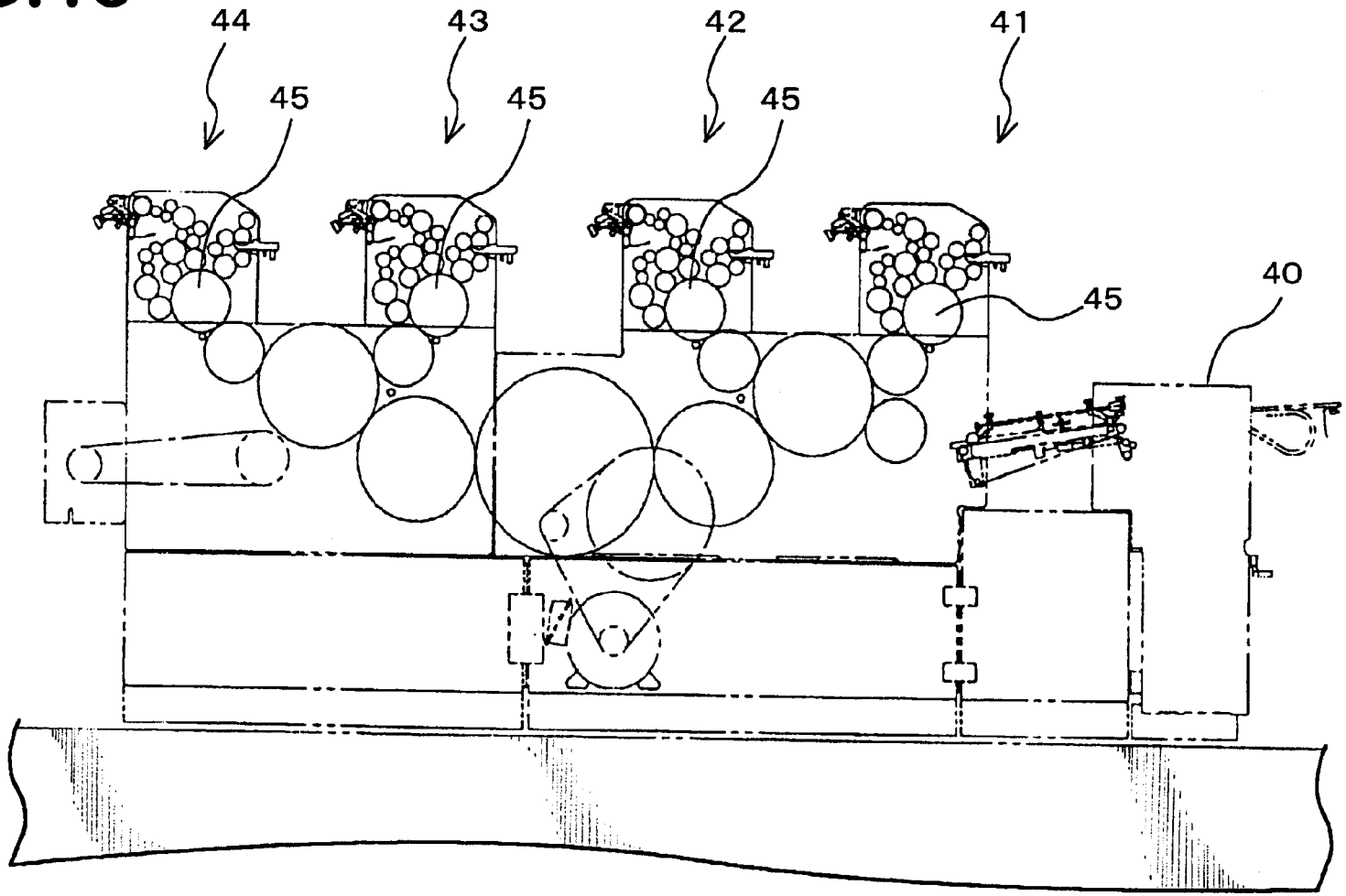
FIG. 13 is a side view illustrating an overall structure of the printing machine.
Figure 14:
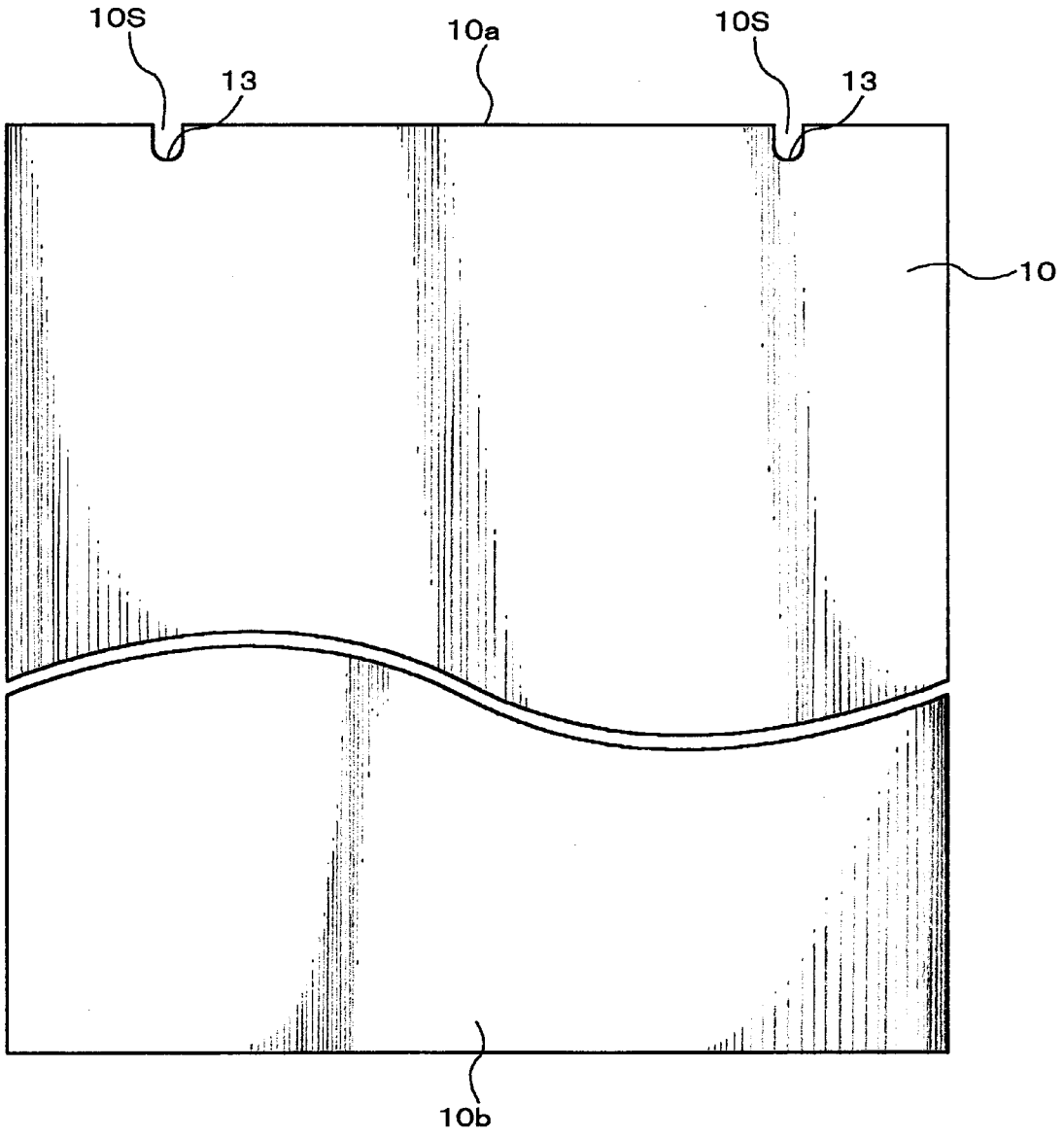
FIG. 14 is a plan view of the printing plate 10.
Figure 15:
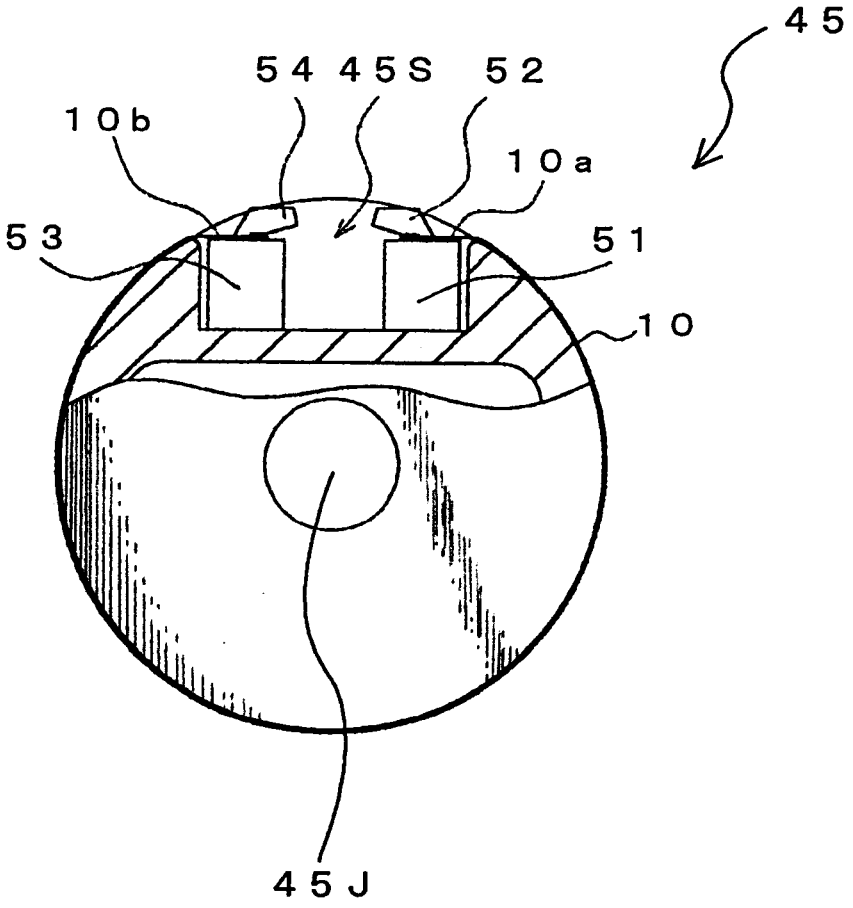
FIG. 15 is a side elevation of the plate cylinder 45 in the prior art.

FIG. 7 is a plan view of a feeder 40 and a first printing unit 41, and FIG. 8 is a side view corresponding to the view shown in FIG. 7. FIG. 9 is a plan view of the first printing unit 41 and a second printing unit 42, and FIG. 10 is a side view corresponding to the view shown in FIG. 9. FIG. 11 a plan view of the second printing unit 42 and a third printing unit 43, and FIG. 12 is a side view corresponding to the view shown in FIG. 11. FIG. 13 is a side view illustrating the overall structure of the printing machine, and FIG. 14 is a plan view of the printing plate 10.

The printing machine in this embodiment comprises the feeder 40, the first printing unit 41, the second printing unit 42, the third printing unit 43, and a fourth printing unit 44 as depicted in FIG. 13. The cylinders 45 are rotatably provided to all the printing units respectively. The plate 10 shown in FIG. 14 is disposed on each of the cylinders 45.

Different images for multi-color printing are formed on the plate 10 disposed on each of the cylinders 45. Sheets fed from the feeder 40 are sequentially printed by the printing units 41, 42, 43, and 44. Upon completion of the printing by the fourth printing unit 44, the sheets thus printed in multi-color are delivered to a delivery table.

The cylinder 45 provided to each of the printing units is supported to the body of the printing machine through a cylinder shaft 45J shown in FIG. 1 so as to rotate around the shaft 45J. A cut-out part 45S is formed in the cylinder 45, the leading edge side clamping base 51 forming a clamping base and the tail edge side clamping base 53 are provided to the cut-out part 45S. A leading edge side clamp 52 is provided at a position upward of the clamping base 51 so as to move within an open position and a close position. A tail edge side clamp 54 is provided at a position upward of the tail edge side clamping base 53 so as to move within an open position and a close position.

In the case of disposing the plate 10 shown in FIG. 14 on the cylinder 45, a leading edge side part 10*a* of the plate 10 forming a fore-end of a printing plate is inserted into a gap formed between the leading edge side clamping base 51 and the leading edge side clamp 52, and the leading edge side part 10*a* is clamped and fixed therebetween by closing the leading edge side clamp 52. Upon clamping the leading edge side part 10*a*, the plate 10 is rolled around a cylinder surface of the cylinder 45 by rotating the cylinder 45 about the shaft 45J such that both the tail edge side clamping base 53 and the tail edge side clamp 54 access to a tail edge side part 10*b*.

Subsequently, the tail edge side part 10*b* is inserted into a gap formed between the tail edge side clamping base 53 and the tail edge side clamp 54, and the tail edge side part 10*b* is clamped therebetween by closing the tail edge side clamp 54. Thereafter, the tail edge side part 10*b* thus clamped is pulled in a direction so as to fit the plate 10 tightly onto the surface of the cylinder 45.

In order to carry out printing work with accuracy, the plate 10 must be disposed at a proper position on the outer surface of the cylinder 45 provided in each of the printing units. To do that, cut-out parts 10S for positioning are formed at two separate positions on the leading edge side part 10*a* of the plate 10 as depicted in FIG. 14.

Two separate positioning pins 11 both forming a reference member responsive to the cut-out parts 10S are provided to the leading edge side clamping base 51 of the cylinder 45 along with the shaft 45J in a fixed fashion as shown in FIG. 1. The operator tries to engage the cut-out parts 10S with the positioning pins 11 when he/she inserts the leading edge side part 10*a* into the gap between the leading edge side clamping base 51 and the leading edge side clamp 52. As a result, positioning of the plate 10 is carried out.

In this case, cut-out planes 13 formed on the cut-out parts 10S are in contact with the positioning pins 11 formed at two separate positions on the clamping base 51. The leading edge side part 10*a* is inserted and clamped between the leading edge side clamping base 51 and the leading edge side clamp 52 by closing the leading edge side clamp 52 under the condition described above.

A plurality of plate guides 15 forming a guide member are respectively provided adjacent to the positioning pins 11. Each of the plate guides 15 comprises a pair of arms 15M at fore-ends thereof as depicted in FIG. 3B. Convex portions 15R are formed on the arms 15M by bending. A space 15S is formed between the arms 15M.

Two of bolt holes 15H are formed on rear-end 15K of the plate guide 15. The plate guides 15 are made of sheet-shaped metal plates in this embodiment. Cut-outs are formed on a plane of the leading edge side clamp 52 at positions adjacent to both the positioning pins 11 and the plate guides 15 as depicted in FIG. 1, so that a part of the positioning pins 11 and the convex portions 15R are exposed from the cut-outs.

Both the plate guides 15 are fixed to the leading edge side clamping base 51 with fixing bolts 16 passing through the bolt holes 15H (FIG. 3B). The plate guides 15 are provided at positions such that each of the positioning pins 11 is located in the space 15S.

A gap L1 is formed between an upper surface 51F of the leading edge side clamping base 51 and the a lower surface of the plate guide 15. The gap L1 is formed within a range from a thickness substantially equal to the plate 10 to a thickness slightly thicker than the plate 10. A printing plate 10 having approximately 0.15 mm in thickness is in use, and the gap L1 is formed approximately 0.5 mm in space in this embodiment.

Typically, the plate 10 is approximately 0.15 mm in thickness, other printing plates having a range approximately 0.1 mm through 0.3 mm in thickness are available in the market. The space of the gap L1 may be varied in accordance with the thickness of the plate 10 being used. In that case, it is preferred to form the gap L1 in a space adding extra space of approximately 0.3 mm to 0.4 mm to the thickness of the plate 10 (the gap L1 is formed in a space of approximately 0.5 mm as a result of adding extra 0.35 mm to the thickness of 0.15 mm in this embodiment).

The gap L1 may be formed in a space within a range from a thickness substantially equal with the plate 10 to that slightly thicker than the plate 10. In this way, the gap L1 may be formed in a space substantially equal to the thickness of the plate 10 such as approximately 0.15 mm as the minimum space, and the gap L1 may also be formed in another space such as 1.0 mm as the maximum space. An inserting gap L2 formed between the convex portions 15R and the upper surface 51F is formed larger in thickness than that of the plate 10 as depicted in FIG. 2.

The operator inserts the leading edge side part 10*a* into the gap L1 formed between the upper surface 51F and the lower surface of the plate guides 15 when the leading edge side part 10*a* is set between the leading edge side clamping base 51 and the leading edge side clamp 52.

Figure 16:
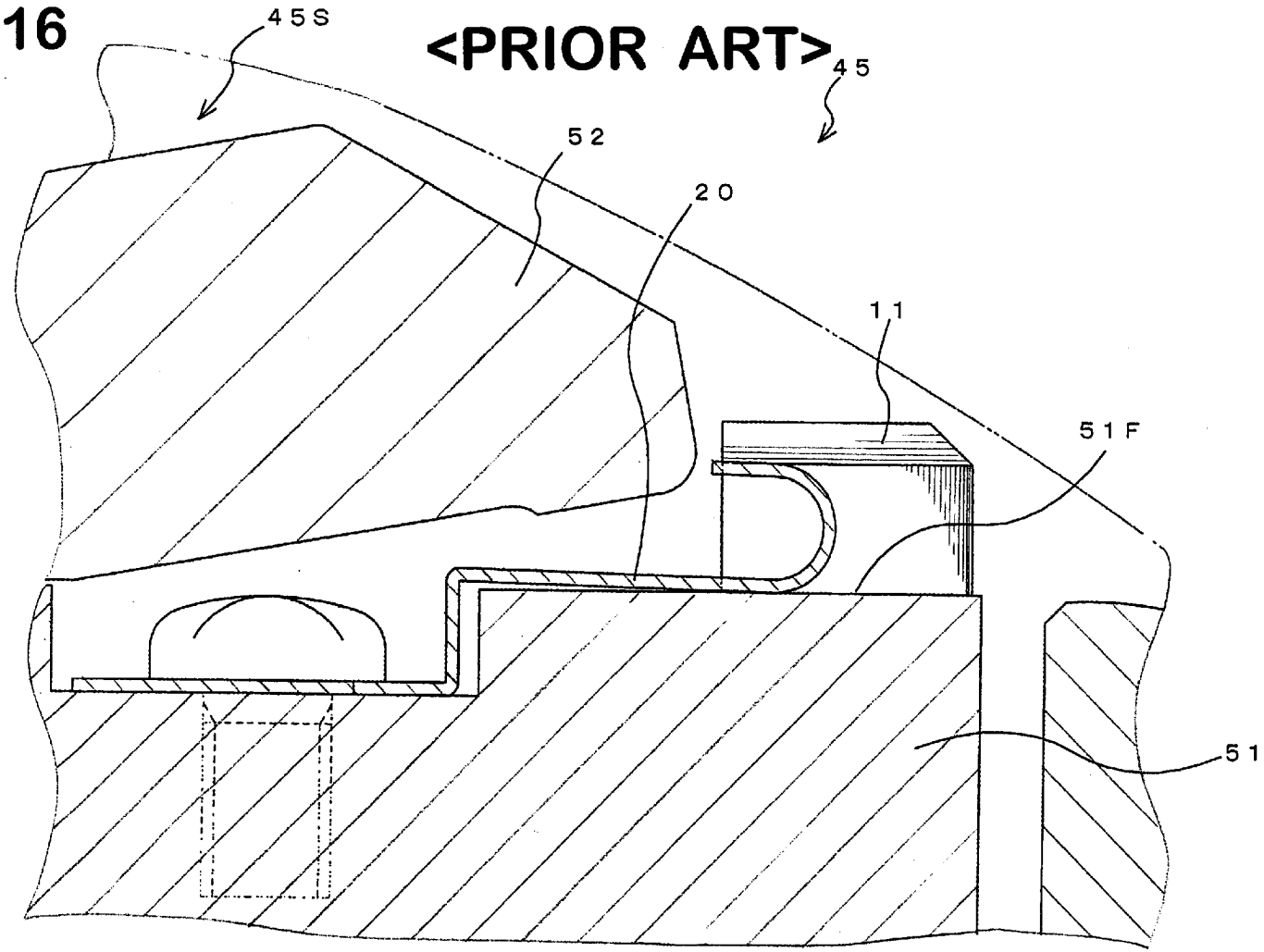
FIG. 16 is an enlarged side elevation of positioning pins 11 provided to the plate cylinder 45.
Figure 17:
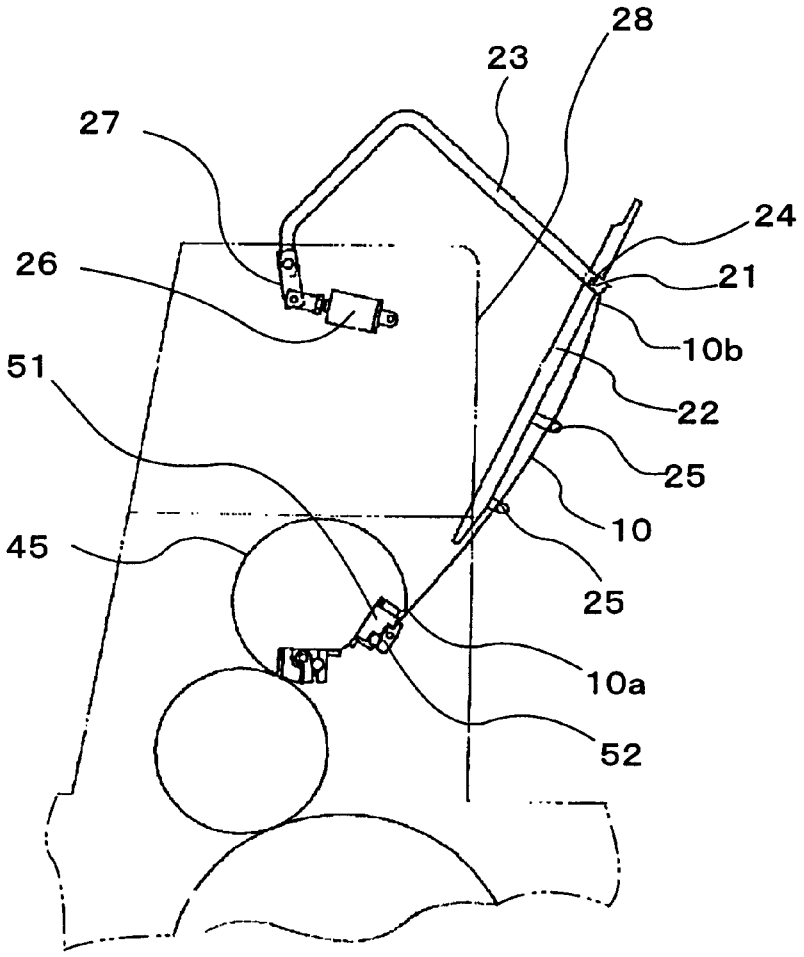
FIG. 17 is a side view illustrating an overall structure of an apparatus for positioning a printing plate in the prior art.

The cut-out planes 13 of the cut-out parts 10S (FIG. 14) can be in contact to the positioning pins 11 with an adequate pressure by smoothly inserting the leading edge side part 10*a* into the gap L1 as a result of forming the gap L1 slightly thicker than the plate 10 (the gap L1 is formed in a space adding extra space of approximately 0.3 mm through 0.4 mm to the plate thickness). In other words, it is not necessary for the operator to give too much force to the leading edge side part 10*a* because the apparatus in this embodiment does not have the temporal fixer 20 which is in contact with the upper surface 51F, unlike the conventional apparatus shown in FIG. 16.

Consequently, diagonal placement of the printing plate 10 on the plate cylinder 45 caused by deformation of the cut-out planes 13 of the cut-out parts 10S as a result of unintentionally applying too much force may be avoided so that printing accuracy can be increased by carrying out accurate positioning of the plate 10.

Further, a part of the plate 10 adjacent to the leading edge side part 10*a* will not come up far from the upper surface 51F of the clamping base 51 even when the cut-out planes 13 of the cut-out parts 10S are in contact with the positioning pins 11 because the gap L1 is formed slightly thicker than the printing plate 10.

Consequently, diagonal images caused by diagonal placement of the leading edge side part 10*a* as a result of applying pushing force to the leading edge side part 10*a* which came up far from the upper surface 51F may be avoided even when the leading edge side part 10*a* is clamped between the leading edge side clamping base 51 and the leading edge side clamp 52 by closing the leading edge side clamp 52. In this way, printing accuracy can be increased by carrying out accurate positioning of the plate 10.

In addition, the convex portions 15R for guiding the leading edge side part 10*a* are formed at the fore-ends of the plate guides 15 and the fore-ends of the guides 15 are located behind a fore-end of the positioning pins 11 in a direction of insertion of the printing plate 10. The inserting gap L2 defined by the convex portions 15R is formed larger in thickness than that of the gap L1.

Thus, work efficiency in disposing the plate 10 on the plate cylinder 45 can be increased by smoothly inserting the leading edge side part 10*a* to the positioning pins 11 as a result of forming the inserting gap L2 slightly thicker than the gap L1 which is formed thicker than the printing plate 10. Further, the curvature of the convex portions 15R smoothly guide the leading edge side part 10*a* to the positioning pins 11 even when the leading edge side part 10*a* is pushed to the middle of the curvature. In this way, the plate 10 can be disposed on the plate cylinder 45 at a proper position by certainly contacting the cut-out planes 13 of the cut-out parts 10S with the positioning pins 11.

The space of the gap L1 can be varied by pushing/pulling the plate guides 15 because rear-ends of the plate guides 15 L3 are secured by the fixing bolts 16 to the leading edge side clamping base 51 at a position far from the convex portions 15R. Consequently, the gap L1 can easily be formed slightly thicker than the plate 10.

In this way, the leading edge side part 10*a* is clamped and fixed between the leading edge side clamping base 51 and the leading edge side clamp 52 after carrying out positioning of the plate 10 by inserting the leading edge side part 10*a* into the gap L1.

Next, FIGS. 4, 5, 6A, 6B and 6C show another embodiment of the guide member used in the apparatus according to the present invention. In this embodiment, both the reference member and the guide member are formed as one unitized component. Each of the unitized positioning pins 12 forming a unitized pin includes a head 12*a*, a leg 12*b*, and a step-shaped portion 12G formed successive to the leg 12*b* and the leg 12*a* as depicted in FIGS. 6A through 6C.

The head 12*a* is formed in rectangular shape, and both the leg 12*b* and the step-shaped portion 12G are formed in semi-cylindrical shape as shown in FIG. 6B and FIG. 6C. The step-shaped portion 12G is formed successive to the leg 12*b*, a part of which overhangs the leg 12*b* on a plane extending to the clamping base 51. Also, the head 12*a* is formed successive to the step-shaped portion 12G, and a part of which overhangs the step-shaped portion 12G on the plane extending to the clamping base 51. The head 12*a* and the step-shaped portion 12G respectively forming the guide member and the reference member in this embodiment.

A part of the leg 12*b* is inserted and embedded into a hole formed in the clamping base 51 as depicted in FIG. 5. As a result, both the step-shaped portion 12G and the head 12*a* are exposed from the upper surface 51F. Another gap L4, a space formed between the upper surface 51F and the bottom of the head 12*a*, that is equivalent to the height of the step-shaped portion 12G, is formed slightly thicker than the plate 10.

In this embodiment, a plate 10 having approximately 0.15 mm in thickness is used, and the gap L4 is formed approximately 0.5 mm in space as described above. The space of the gap L4 may be varied in accordance with the thickness of the plate 10 being used similar to the case described with reference to FIG. 2. It is preferred to form the gap L4 in a space adding extra space of approximately 0.3 mm through 0.4 mm to the plate thickness.

The gap L4 may be formed in a space within a range from a thickness substantially equal with the plate 10 to that of slightly thicker than the plate 10. In this way, the gap L4 may be formed in a space substantially equal to the thickness of the plate 10 such as approximately 0.15 mm as the minimum space, and the gap L4 may also be formed in another space such as 1.0 mm as the maximum space.

The operator inserts the leading edge side part 10*a* into the gap L4 formed between the upper surface 51F and the lower surface of the head 12*a* when the leading edge side part 10*a* is set between the leading edge side clamping base 51 and the leading edge side clamp 52. Each of the cut-out planes 13 (FIG. 14) is in contact with the step-shaped portion 12G as a result of engaging the cut-out parts 10S with step-shaped portion 12G.

The cut-out planes 13 of the cut-out parts 10S (FIG. 14) can be in contact to the step-shaped portion 12G with an adequate pressure by smoothly inserting the leading edge side part 10*a* into the gap L4 as a result of forming the gap L4 slightly thicker than the plate thickness. In other words, it is not necessary for the operator to give too much force to the leading edge side part 10*a* because the apparatus in this embodiment does not have the temporal fixer 20 which is in tight contact with the upper surface 51F, unlike to the conventional apparatus shown in FIG. 16.

Consequently, diagonal placement of the printing plate 10 on the plate cylinder 45 caused by deformation of the cut-out planes 13 of the cut-out parts 10S as a result of unintentionally applying too much force may be avoided, so that printing accuracy can be increased by carrying out accurate positioning of the plate 10.

Further, a part of the plate 10 adjacent to the leading edge side part 10*a* does not rise to the upper surface 51F of the clamping base 51 even when the cut-out planes 13 of the cut-out parts 10S are in contact with the step-shaped portion 12G because the gap L4 formed between the upper surface 51F and the lower surface of the head 12*a* is spaced in a thickness slightly thicker than the plate thickness.

Consequently, diagonal images caused by diagonal placement of the leading edge side part 10*a* as a result of applying a pushing force to the leading edge side part 10*a* which came up far from the upper surface 51F can be avoided even when the leading edge side part 10*a* is clamped between the leading edge side clamping base 51 and the leading edge side clamp 52 by closing the leading edge side clamp 52. In this way, printing accuracy can be increased by carrying out accurate positioning of the plate 10.

In this way, the leading edge side part 10*a* is clamped and fixed between the leading edge side clamping base 51 and the leading edge side clamp 52 after carrying out positioning of the plate 10 by inserting the leading edge side part 10*a* into the gap L4.

Next, the positioning apparatus inserting the leading edge side part 10*a* into a gap between the leading edge side clamping base 51 and the leading edge side clamp 52 while contacting the tail edge side part 10*b* forming a rear-end of the plate 10 with a contact member by using flexure of the plate 10 will be described. In this embodiment, the positioning apparatus is respectively provided to a first printing unit 41, a second printing unit 42, a third printing unit 43, and a fourth printing unit 44, shown in FIG. 13.

Firstly, the structure and the operation of the apparatus provided to the first printing unit 41 will be described with reference to FIGS. 7 and 8. A bar 17 is provided so as to lay across a feeder 40. A plate supporting guide 3 forming an intermediate supporting member is provided to the bar 17 at the substantially center thereof. In other words, the supporting guide 3 is provided to a cover for body 40*c* of the feeder 40 through the bar 17. The supporting guide 3 is formed in semi U-shape, and it is disposed so as to extend to the first printing unit 41 in an inclined fashion as shown in FIG. 8.

Two of tail edge side stoppers 2 forming the contact member are provided to the supporting guide 3. The stoppers 2 are formed in cylindrical shape in this embodiment. Although, the stoppers 2 are fixed to the supporting guide 3 under the normal condition, the position thereof can be varied along with the supporting guide 3 by slide.

On the other hand, an inserting hole 41S for inserting the plate 10 is formed on the first printing unit 41. The operator opens a cover 41*b* toward his/her side by pulling it about a shaft 41J when the operator disposes the plate 10 on the cylinder 45 provided in the printing unit 41. The leading edge side part 10*a* is set between the upper surface 51F and the lower surface of the plate guides 15 as a result of inserting the leading edge side part 10*a* into the gap L1 described earlier with reference to FIG. 2.

Thereafter, the operator disposes the plate 10 so as to contact the tail edge side part 10*b* with edges 2M of the stoppers 2. At that time, the stoppers 2 are fixed at positions so as to cause flexure on the plate 10 as shown in FIG. 8. The leading edge side part 10*a* extends toward the positioning pins 11 depicted in FIG. 2 as a result of a restoring force generated by flexure of the plate 10 when the operator release his/her hands from the plate 10 under the condition shown in FIG. 8.

The stoppers 2 and the positioning pins 11 are respectively provided at positions such that a line across the edges 2M of the stoppers 2 and another line across the positioning pins 11 provided to the cylinder 45 are parallel with each other as depicted in FIG. 7. In other words, the stoppers 2 and the positioning pins 11 are respectively provided at positions such that the line (a first straight line) formed of the fore-end of the plate 10 being in contact with the positioning pins 11 and the other line (a second straight line) formed of the rear-end of the plate 10 being in contact with the stoppers 2 are parallel with each other. In this way, the leading edge side part 10*a* is in contact with the positioning pins 11 with equal force.

The leading edge side part 10*a* is in contact with the stoppers 2 as a result of guiding the plate 10 upwardly to the cylinder 45 as shown in FIG. 8. Further, part of an intermediate portion lay between the leading edge side part 10*a* and the tail edge side part 10*b* is supported by the supporting guide 3, and another part of the intermediate portion is also supported by a lower side of the inserting hole 41S.

Thus, the stability of support for the plate 10 can be increased because the leading edge side part 10*a* is guided upwardly to the cylinder 45 and plural parts of the intermediate portion are supported by the supporting guide 3 and the lower side of the inserting hole 41S. The structure of the positioning apparatus may be simplified because no complex mechanisms for suspending the printing plate 10 downwardly to the plate cylinder 45 are needed.

The force generated by the restoration of the plate 10 and applied to the positioning pins 11 through the leading edge side part 10*a* is determined by a degree of flexure on the plate 10, that is defined by a distance between the positioning pins 11 and the stoppers 2. This allows the plate 10 to constantly push the leading edge side part 10*a* to the positioning pins 11 with equal force.

Consequently, diagonal placement of the printing plate 10 on the plate cylinder 45 caused by deformation of the cut-out planes 13 of the cut-out parts 10S as a result of unintentionally applying too much force, and that caused by uneven contact of the cut-out planes 13 to the positioning pins 11 as a result of applying less force to the plate 10 may be avoided because the leading edge side part 10*a* can be constantly in contact with the positing pins 11 with adequate force. In this way, printing accuracy can be increased by carrying out accurate positioning of the plate 10 without demanding much skill in plate positioning.

Further, the leading edge side part 10*a* can be in contact with the positioning pins 11 smoothly and certainly as a result of a restoring force caused by flexure of the plate 10 because the plate guides 15 are provided to the clamping base 51 so as to form the gap L1 having a thickness slightly thicker than the plate thickness. In addition, printing accuracy can also be increased by carrying out accurate positioning of the plate 10 by avoiding rise of the leading edge side part 10*a* from the upper surface 51F.

Next, the structure and the operation of the positioning apparatus provided to the second printing unit 42 will be described with reference to FIGS. 9 and 10. Similar apparatus shown in FIGS. 9 and 10 is provided to the fourth printing unit 44. The description of the apparatus applied to the fourth printing unit 44 is omitted for simplicity.

Another two of tail edge side stoppers 4 also forming the contact member are provided on a safety cover 41*a* (exterior of body of the printing machine) standing vertically to the rear side of the first printing unit 41 as shown in FIG. 10. The stoppers 4 are formed in cylindrical shape in this embodiment. Further, one side stopper 7 forming a side positioning member is provided on another safety cover 42*c* positioned horizontally to the printing unit 42.

On the other hand, another inserting hole 42S for inserting the plate 10 is formed on the safety cover 42*a* of the second printing unit 42. The operator opens a cover 42*b* toward his/her side by pulling it about a shaft 42J when the operator disposes the plate 10 on the cylinder 45 provided in the printing unit 42. The leading edge side part 10*a* is set between the upper surface 51F and the lower surface of the plate guides 15 as a result of inserting the leading edge side part 10*a* into the gap L1 described earlier with reference to FIG. 2.

Thereafter, the tail edge side part 10*b* will be in contact with edges 4M of the stoppers 4 while contacting a side of the plate 10 with a side 7M of the side stopper 7. At that time, the stoppers 4 are fixed at positions so as to cause flexure on the plate 10 as shown in FIG. 10. The leading edge side part 10*a* extends toward the positioning pins 11 as depicted in FIG. 2 by a restoring force generated by flexure of the plate 10 when the operator release his/her hands from the plate 10 under the condition shown in FIG. 10.

The side stopper 7 is provided at a position such that the side 7M thereof is in contact with the side of the plate 10 disposed at the proper position. In this way, the plate 10 can further be disposed properly without causing twist thereof by contacting the side thereof with the side 7M of the stopper 7.

The stoppers 4 are provided to the positioning pins 11 at positions such that a line across the edges 4M of the stoppers 4 and another line across the positioning pins 11 are parallel with each other as in FIG. 9. In other words, the positioning pins 11 and the stoppers 4 are respectively provided at positions such that a line (a first straight line) formed at the fore-end of the plate 10 in contact with the positioning pins 11 and another line (a second straight line) formed at the rear-end of the plate 10 in contact with the stoppers 4 are parallel with each other. Consequently, the leading edge side part 10*a* is in contact with the positioning pins 11 with equal force.

The leading edge side part 10*a* is in contact with the positioning pins 11 as a result of guiding the plate 10 upwardly to the cylinder 45 as shown in FIG. 10 similar to the case of the first printing unit 41 described earlier with reference to FIGS. 7, 8. Further, part of an intermediate portion (an intermediate part) lay between the leading edge side part 10*a* and the tail edge side part 10*b* is supported by the safety cover 42*c* (exterior of body of the printing machine) forming a cover for body of the printing machine positioned horizontally to the second printing unit 42, and another part of the intermediate portion is also supported by a lower side of the inserting hole 42S.

In this way, the plate 10 is supported with stability because the leading edge side part 10*a* is guided upwardly to the cylinder 45 and plural parts of the intermediate portions are supported by the safety cover 42*c* and the lower side of the inserting hole 42S. The structure of the apparatus can be simplified because no complex mechanisms for suspending the printing plate 10 downwardly to the plate cylinder 45 are needed. Other functions and advantages of the apparatus are similar to that of the apparatus used for the first printing unit 41 described with reference to FIGS. 7, 8.

Continuously, the structure and the operation of the apparatus provided to the third printing unit 43 will be described with reference to FIGS. 11, 12. Two of tail edge side stoppers 5 further forming the contact member are provided on a safety cover 43*c* (exterior of body of the printing machine) functioning as a cover for body of the printing machine extending horizontally to the third printing unit 43. The stoppers 5 are also formed in cylindrical shape in this embodiment.

Further, a single side stopper 8 forming a side positioning member is provided on the safety cover 43*c*. In addition, a plate supporting guide 6 forming an intermediate supporting member is also provided on the safety cover 43*c*. The plate supporting guide 6 is formed in semi U-shape.

On the other hand, another inserting hole 43S for inserting the plate 10 is formed on the safety cover 43*a* of the printing unit 43 standing vertically to the rear side of the second printing unit 43. The operator opens a cover 43*b* toward his/her side by pulling it about a shaft 43J when the operator disposes the plate 10 on the cylinder 45 provided in the printing unit 43. The leading edge side part 10*a* is set between the upper surface 51F and the lower surface of the plate guides 15 as a result of inserting the leading edge side part 10*a* into the gap L1 described earlier with reference to FIG. 2.

Thereafter, the tail edge side part 10*b* will be in contact with edges 8M of the stoppers 8 while contacting a side of the plate 10 with a side 5M of the side stopper 5. At that time, the stoppers 5 are fixed at positions so as to cause flexure on the plate 10 as shown in FIG. 12. The leading edge side part 10*a* extends toward the positioning pins 11 as depicted in FIG. 2 by a restoring force generated by flexure of the plate 10 when the operator releases his/her hands from the plate 10 under the condition shown in FIG. 12.

The side stopper 8 is provided at a position such that the side 8M thereof is in contact with a side of the plate 10 disposed at the proper position. In this way, the plate 10 can further be disposed properly without causing twist thereof by contacting the side of the plate 10 with the side 8M of the stopper 8.

The stoppers 5 are provided to the positioning pins 11 at positions such that a line across the edges 5M of the stoppers 5 and another line across the positioning pins 11 provided to the cylinder 45 are parallel with each other as in FIG. 11. In other words, the positioning pins 11 and the stoppers 5 are respectively provided at positions such that a line (a first straight line) formed of the fore-end of the plate 10 in contact with the positioning pins 11 and another line (a second straight line) formed of the rear-end of the plate 10 in contact with the stoppers 5 are parallel with each other. Consequently, the leading edge side part 10*a* is in contact with the positioning pins 11 with equal force.

The leading edge side part 10*a* is in contact with the positioning pins 11 as a result of guiding the plate 10 upwardly to the cylinder 45 as shown in FIG. 12 similar to the case of the first printing unit 41 described earlier with reference to FIGS. 7, 8. Further, part of an intermediate portion (an intermediate part) lay between the leading edge side part 10*a* and the tail edge side part 10*b* is supported by the plate supporting guide 6 and the safety cover 43*c*, and another part of the intermediate portion is also supported by a lower side of the inserting hole 43S.

In this way, the plate 10 can be supported with stability because the leading edge side part 10*a* is guided upwardly to the cylinder 45 and plural parts of the intermediate portions are supported by the plate supporting guide 6 and the safety cover 43*c* and the lower side of the inserting hole 43S. The structure of the apparatus may be simplified because no complex mechanisms for suspending the printing plate 10 downwardly to the plate cylinder 45 are needed. Other functions and advantages of the apparatus are similar to that of the apparatus used for the first printing unit 41 described with reference to FIGS. 7, 8.

As described above, the leading edge side part 10*a* can be constantly in contact with the positing pins 11 with adequate and equal force by contacting the tail edge side part 10*b* with the stoppers 2, 4, and 5 each forming the contact member and extending the leading edge side part 10*a* toward the positioning pins 11 as a result of a restoring force generated by flexure of the plate 10.

The apparatus for positioning a printing plate to a plate cylinder according to the present invention is not limited to the structure described in the embodiments. Although, the plate guides 15 and the head 12*a* are used as the contact member in the embodiments, any other component(s) acting as the contact member may be used regardless of its shape and/or the structure.

Further, the leading edge side part 10*a* is inserted into the gap L1 formed between the clamping base 51 and the plate guide 15 depicted in FIG. 1 through FIG. 3 by using the apparatus shown in FIG. 7 through FIG. 12. The structures realizing the present invention are not limited to these. The leading edge side part 10*a* may be inserted into the gap L4 formed between the upper surface 51F and the bottom of the head 12*a* by using the positioning pin 12 shown through FIG. 4 through FIG. 6 as well as applying the apparatuses shown in FIG. 7 through FIG. 12 thereto.

As described earlier, the force generated by the restoration of the plate 10 applied to the positioning pins 11 and 12 through the leading edge side part 10*a* can be adjusted by varying the degree of flexure on the plate 10, that is defined by the distance between the positioning pins 11, 12 and the stoppers 2 because the position of the stoppers 2 shown in FIGS. 7, 8 can be varied along with the supporting guide 3 by slide.

Similar to above, the force applied to the positioning pins 11 and 12 through the leading edge side part 10*a* can also be adjusted by providing the stoppers 4 capable of sliding shown in FIGS. 9, 10 on the safety cover 41*a*. The force applied to the positioning pins 11 and 12 through the leading edge side part 10*a* can further be adjusted by providing the stoppers 5 capable of sliding shown in FIGS. 11, 12 on the safety cover 43*c*.

In order to apply equal force to the two separate positioning pins 11, 12, two of the tail edge side stoppers 2, 4, and 5 are respectively provided to positions corresponding to the positioning pins in the embodiments. It is possible to employ a structure in which one single stopper is provided at a position corresponding to substantially center of the two separate positioning pins 11, 12 in order to apply equal force thereto. Also, a total of more than two tail edge side stoppers may be provided to contact with the tail edge side part 10*b*.

Although, the stoppers 2, 4, and 5, each formed in cylindrical shape are used as the contact member in the embodiments, other stoppers having different shape and/or structure may be used instead therefor. For example, a lateral shaped stopper extending so as to be along the tail edge side part 10*b* may be provided. The use of the lateral shaped stopper allows the apparatus to apply equal force to the positioning pins 11, 12 even when one single lateral shaped stopper is provided.

While the invention has been described in its preferred embodiments, it is to be understood that the words which have been used are words of description rather than limitation and that changes within the purview of the appended claims can be made without departing from the true scope and spirit of the invention in its broader aspects.

The apparatus according to the present invention is characterized in that, a reference member is provided to a clamping base of the plate cylinder of the printing machine, the reference member being in contact with a fore-end of the printing plate for positioning the printing plate to the plate cylinder. Also, a guide member provided adjacent to the reference member for guiding the fore-end of the printing plate to the reference member is arranged so as to form a gap therebetween within a range from a thickness substantially equal to the printing plate to a thickness slightly thicker than the printing plate.

It is not necessary for the operator to give too much force to the fore-end of the printing plate for inserting it into a gap formed between a clamping base and the guide member when the operator attempts to contact the fore-end with the reference member because the reference member is arranged so as to form the gap therebetween within a range from a thickness substantially equal to the printing plate to a thickness slightly thicker than the printing plate. Consequently, diagonal placement of the printing plate on the plate cylinder caused by deformation of the fore-end of the printing plate as a result of applying too much force may be avoided so that printing accuracy can be increased by carrying out accurate positioning of the printing plate.

Further, a part of the plate adjacent to the fore-end of the printing plate will not come up far from the clamping base even when the fore-end is in contact with the reference member because the gap is formed within a range from a thickness substantially equal to the printing plate to a thickness slightly thicker than the printing plate. Consequently, diagonal images caused by diagonal placement of the fore-end of the printing plate as a result of applying pushing force to the fore-end which came up far from the clamping base may be avoided. In this way, printing accuracy can be increased by carrying out accurate positioning of the printing plate.

Also, the apparatus according to the present invention is characterized in that, a contact member contacting with the rear-end of the printing plate is provided. The fore-end of the printing plate is pushed to the reference member by restoring force caused by flexure of the printing plate generated when the fore-end of the printing plate is positioned to the reference member and the rear-end thereof is in contact with the contact member.

The force generated by the restoration of the printing plate and applied to the reference member through the fore-end of the printing plate is determined by a degree of flexure on the printing plate, that is defined by a distance between the reference member and the contact member. This allows the printing plate to constantly extend the fore-end of the printing plate toward the reference member with equal force.

Consequently, diagonal placement of the printing plate on the plate cylinder caused by deformation of the fore-end of the printing plate as a result of applying too much force, and that caused by uneven contact of the fore-end to the reference member as a result of applying less force to the printing plate may be avoided because the fore-end can be constantly in contact with the reference member with adequate force. In this way, printing accuracy can be increased by carrying out accurate positioning of the printing plate without demanding much skill in plate positioning.

Further, the fore-end of the printing plate can be in contact with the reference member smoothly and certainly as a result of a restoring force caused by flexure of the printing plate because the guide member is provided to the clamping base so as to form a gap therebetween within a range from a thickness substantially equal to the printing plate to a thickness slightly thicker than the printing plate. In addition, printing accuracy can also be increased by carrying out accurate positioning of the printing plate by avoiding the coming-up of the fore-end from the clamping base.

Further, the apparatus according to the present invention is characterized in that, the fore-end of the printing plate is in contact with the reference member as a result of guiding the printing plate upwardly to the plate cylinder. The printing plate is held on an outer surface of the cover for body in which the cylinder is provided when the rear-end of the printing plate is in contact with the contact member.

In this way, the printing plate can be held on the outer surface of the cover for the body when the rear-end of the printing plate is in contact with the reference member because the fore-end thereof is in contact with the reference member as a result of guiding the printing plate upwardly to the plate cylinder. In other words, the structure of the apparatus can be simplified and having increased stability of support for the printing plate because no complex mechanisms for suspending the printing plate downwardly to the plate cylinder are needed.

Still further, the fore-end of the printing plate is in contact with the reference member as a result of guiding the printing plate upwardly to the plate cylinder. An intermediate supporting member for supporting an intermediate part of the printing plate is provided to the body cover.

In this way, the printing plate can be supported with stability because the fore-end thereof is in contact with the reference member as a result of guiding the printing plate upwardly to the plate cylinder and an intermediate portion thereof is supported by an intermediate supporting member. Further, the structure of the apparatus can be simplified because no complex mechanisms for suspending the printing plate downwardly to the plate cylinder are needed.

What is claimed is:

1. An apparatus for positioning a printing plate to a plate cylinder of a printing machine comprising:

a plate cylinder having a clamping base;

at least one reference member provided to the clamping base of the plate cylinder of the printing machine, the at least one reference member being in contact with a fore-end of the printing plate for positioning the printing plate to the plate cylinder; and a guide member provided adjacent to the at least one reference member for guiding the fore-end of the printing plate to the reference member by insertion, the guide member being arranged at a position such that a fore-end of the guide member is located behind a fore-end of the reference member in a direction of the insertion, the guide member being provided to the clamping base so as to form a gap having a range from a thickness substantially equal to the printing plate to a thickness slightly thicker than the printing plate.

2. The apparatus in accordance with claim 1, wherein said guide member includes a convex portion for guiding the fore-end of the printing plate to the reference member, said guide member being at a position capable of holding the fore-end of the printing plate.

3. The apparatus in accordance with claim 2, wherein the guide member is a sheet-shaped material with a convex portion formed thereon.

4. The apparatus in accordance with claim 1 or claim 2, wherein a cut-out is formed on the guide member, and wherein the guide member is provided to the clamping base so as to locate the reference member in the cut-out.

5. The apparatus in accordance with claim 1, wherein the reference member and the guide member are formed as one unitized pin.

6. The apparatus in accordance with claim 5, wherein the unitized pin includes a leg, a part of which is embedding into the clamping base; a step-shaped portion formed successive to the leg and a part of which overhangs the leg on a plane extending over the clamping base; and a head formed successive to the step-shaped portion and a part of which overhangs the step-shaped portion on the plane extending over the clamping base; and wherein the step-shaped portion and the head respectively function as the guide member and the reference member.

7. The apparatus in accordance with claim 1, wherein the apparatus further comprises a cover for a body of the printing machine located at a position outside of the plate cylinder; and at least one contact member provided to the cover for holding a rear-end of the printing plate;

and wherein the fore-end of the printing plate is pushed to the at least one reference member by restoring force caused by flexure of the printing plate generated when the fore-end of the printing plate is positioned to the at least one reference member and the rear-end thereof is in contact with the at least one contact member.

8. The apparatus in accordance with claim 7, wherein the at least one reference member and the at least one contact member are respectively provided at positions such that a first straight line formed of the fore-end of the printing plate being in contact with the at least one reference member and a second straight line formed of the rear-end of the printing plate being in contact with the at least one contact member are parallel with each other.

9. The apparatus in accordance with claim 7, wherein a plurality of the reference members are provided to the clamping base, and wherein a plurality of the contact members are provided to the clamping base.

10. The apparatus in accordance with claim 7, wherein the fore-end of the printing plate is in contact with the at least one reference member as a result of guiding the printing plate upwardly to the plate cylinder, and wherein the printing plate is held on an outer surface of the cover for the body when the rear-end of the printing plate is in contact with the at least one contact member.

11. The apparatus in accordance with claim 7, wherein the fore-end of the printing plate is in contact with the at least one reference member as a result of guiding the printing plate upwardly to the plate cylinder, and wherein an intermediate supporting member for supporting an intermediate part of the printing plate is provided to the cover for the body.

12. The apparatus in accordance with claim 1, wherein the apparatus further comprises a cover for a body of the printing machine located at a position outside of the plate cylinder; an intermediate supporting member provided to the cover; and a contact member provided to the intermediate supporting member for holding a rear-end of the printing plate;

and wherein the fore-end of the printing plate is pushed to the at least one reference member by restoring force caused by flexure of the printing plate generated when the fore-end of the printing plate is positioned to the at least one reference member and an intermediate part of the printing plate is supported with the intermediate supporting member while holding the rear-end thereof with the contact member.

13. The apparatus in accordance with claim 12, wherein the contact member is movable along with the intermediate supporting member and thereby a position of the intermediate supporting member is changeable.

14. The apparatus in accordance with claim 7 or claim 12, wherein a side positioning member is provided to the cover, and wherein positioning of a side of the printing plate is carried out when the rear-end of the printing plate is in contact with the contact member.

* * * * *